US011603841B2

(12) United States Patent
Choi et al.

(10) Patent No.: US 11,603,841 B2
(45) Date of Patent: Mar. 14, 2023

(54) SCROLL COMPRESSOR

(71) Applicant: LG ELECTRONICS INC., Seoul (KR)

(72) Inventors: Yongkyu Choi, Seoul (KR); Junghoon Park, Seoul (KR); Taekyoung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 37 days.

(21) Appl. No.: 17/202,937

(22) Filed: Mar. 16, 2021

(65) Prior Publication Data

US 2022/0099094 A1 Mar. 31, 2022

(30) Foreign Application Priority Data

Sep. 25, 2020 (KR) ..... 10-2020-0124936

(51) Int. Cl.

| | |
|---|---|
| ***F04B 39/02*** | (2006.01) |
| ***F04C 15/00*** | (2006.01) |
| ***F04C 29/02*** | (2006.01) |
| ***F04C 2/02*** | (2006.01) |

(52) U.S. Cl.

CPC ..... *F04C 29/021* (2013.01); *F04B 39/0207* (2013.01); *F04C 2/025* (2013.01); *F04C 15/0092* (2013.01); *F04C 29/028* (2013.01); *F04C 2240/30* (2013.01); *F04C 2240/60* (2013.01); *F04C 2240/81* (2013.01)

(58) Field of Classification Search

CPC .... F04C 29/021; F04C 2/025; F04C 15/0092; F04C 29/028; F04B 39/0207

See application file for complete search history.

(56) References Cited

U.S. PATENT DOCUMENTS

| | | | | |
|---|---|---|---|---|
| 4,676,075 | A | 6/1987 | Shiibayashi | |
| 6,071,104 | A * | 6/2000 | Sakimoto | F04C 23/008 418/94 |
| 2004/0024495 | A1 * | 2/2004 | Sunderland | F25B 49/02 62/132 |
| 2012/0156068 | A1 | 6/2012 | Shiibayashi et al. | |

(Continued)

FOREIGN PATENT DOCUMENTS

| | | |
|---|---|---|
| EP | 1806475 | 7/2007 |
| EP | 3657099 | 5/2020 |

(Continued)

OTHER PUBLICATIONS

English translation of JPH06185479 by PE2E, Nov. 2, 2022.*
Extended European Search Report in European Appln. No. 21163597.4, dated Jul. 13, 2021, 5 pages.

*Primary Examiner* — Deming Wan
(74) *Attorney, Agent, or Firm* — Fish & Richardson P.C.

(57) ABSTRACT

A scroll compressor includes an oil circulation pipe having one end inserted through a casing to be connected to an oil storage space inside the casing and another end connected to a suction passage for supplying refrigerant from outside of the casing to a compression chamber, an oil circulation valve disposed between the both ends of the oil circulation pipe to selectively open or close the oil circulation pipe, and a controller to control an opening or closing operation of the oil circulation pipe to reduce or eliminate frictional loss due to a shortage of oil by adjusting an oil level of the oil storage space at an initial operation.

20 Claims, 28 Drawing Sheets

(56) References Cited

U.S. PATENT DOCUMENTS

| | | | | |
|---|---|---|---|---|
| 2014/0056727 | A1* | 2/2014 | Koyama | F04C 18/0215 417/228 |
| 2016/0018148 | A1* | 1/2016 | Yura | F04C 29/028 62/192 |
| 2016/0252092 | A1 | 9/2016 | Kulkarni et al. | |

FOREIGN PATENT DOCUMENTS

| | | | | |
|---|---|---|---|---|
| JP | H06185479 | A * | 7/1994 | F04C 18/02 |
| KR | 20060119318 | | 11/2006 | |
| KR | 100864754 | | 10/2008 | |
| WO | WO2019231203 | | 12/2019 | |

* cited by examiner (a)

(b)

(a)

(b)

(c)

SCROLL COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2020-0124936, filed on Sep. 25, 2020, the contents of which is incorporated by reference herein in its entirety.

BACKGROUND

1. Technical Field

The present disclosure relates to a scroll compressor, and more particularly, a high-pressure and bottom compression type scroll compressor.

2. Description of the Related Art

A scroll compressor is a compressor forming a compression chamber including a suction chamber, an intermediate pressure chamber, and a discharge chamber between both scrolls while the plurality of scrolls is in an engaged state. Scroll compressors may obtain a relatively high compression ratio as compared with other types of compressors while obtaining stable torque by smoothly performing suction, compression, and discharge strokes of refrigerant. Therefore, the scroll compressors are widely used for compressing refrigerant in air conditioners or the like.

Since the scroll compressor compresses refrigerant using rotational force generated by a motor, oil is supplied between components that perform a rotational motion by the rotational force such that the scroll compressor smoothly operates.

The scroll compressor is provided with an oil storage space located below a compression unit to store oil thereon. The oil stored in the oil storage space circulates inside the scroll compressor to be supplied to each bearing surface of the scroll compressor and/or the compression unit and flow back into the oil storage space in a repeating manner.

However, when the scroll compressor is initially operated, refrigerant in a liquid state (hereinafter, abbreviated as liquid refrigerant) which flows back into an inner space of a casing remains in the inner space without being vaporized due to a low internal temperature of the inner space. The liquid refrigerant may be filled in the oil storage space together with the oil. Accordingly, the rate of the liquid refrigerant to the oil may increase and the concentration of mixed oil (the mixture of the refrigerant and the oil) may be lowered. As a result, low-concentration oil may be supplied to the bearing surfaces and/or the compression unit, which may cause the bearing surfaces and/or the compression unit to be worn and damaged and shorten lifespan.

In addition, when the liquid refrigerant is excessively increased, the liquid refrigerant having a relatively high specific gravity may be separately gathered in a lower layer of the oil storage space and the oil may separately form an upper layer of the oil storage space, namely, a so-called two-layer separation phenomenon between the liquid refrigerant and the oil (hereinafter, abbreviated as two-layer separation) may occur. This may cause the liquid refrigerant to be mainly supplied to an oil supply pipe, thereby further wearing and damaging the bearing surfaces and/or the compression unit or further shortening the lifespan.

In addition, when the internal temperature of the casing increases during a normal operation of the scroll compressor in a state where the ratio of the liquid refrigerant in the mixed oil is high, the liquid refrigerant may rapidly be vaporized from the mixed oil accumulated in the oil storage space. At this time, since the ratio of the liquid refrigerant in the mixed oil is high, an amount of oil actually stored in the oil storage space may be decreased rapidly if the liquid refrigerant is vaporized. Then, an oil level of the mixed oil may become lower than the oil supply pipe, which may interfere with the oil supply, thereby causing a fatal damage to the scroll compressor.

Patent Document 1 (Korean Patent Laid-Open Publication No. 10-2006-0119318) discloses a scroll compressor including a pipe through which a discharged high-temperature refrigerant partially moves into the oil storage space and a pipe through which a sucked low-temperature refrigerant partially moves into the oil storage space. Specifically, Patent Document 1 discloses a scroll compressor having a structure capable of heating or cooling oil in an oil storage space by controlling each pipe through a valve.

However, Patent Document 1 requires two pipes having valves, which complicates the structure of the scroll compressor, increases manufacturing costs. Even at an initial operation, discharged refrigerant has a relatively low temperature.

For this reason, Patent Document 1 makes it difficult to rapidly increase the internal temperature of the inner space of the casing during the initial operation. As a result, the liquid refrigerant is more accumulated in the oil storage space, thereby further lowering the concentration of the oil.

In addition, Patent Document 2 (Korean Patent Registration Publication No. 10-0864754) discloses a compressor including a separate oil supply pipe for supplying oil located in an upper layer to a compression unit. Specifically, Patent Document 2 discloses a compressor having a structure for intensively supplying oil when two-layer separation occurs between a liquid refrigerant and oil under a low-temperature heating operation condition.

However, Patent Document 2 merely discloses a structure capable of solving the problem that is caused when the two-layer separation occurs while operating in a low-temperature heating condition, and has a limitation that the two-layer separation cannot be solved.

SUMMARY

One aspect of the present disclosure is to provide a scroll compressor capable of increasing concentration of oil in a casing.

Another aspect of the present disclosure is to provide a scroll compressor capable of lowering saturation concentration of liquid refrigerant in mixed oil by increasing internal temperature of a casing.

Still another aspect of the present disclosure is to provide a scroll compressor capable of increasing internal temperature of a casing by circulating mixed oil in the casing.

Still another aspect of the present disclosure is to provide a scroll compressor capable of properly controlling an amount of mixed oil in consideration of an oil level and temperature while the mixed oil in a casing circulates.

Still another aspect of the present disclosure is to provide a scroll compressor capable of increasing possibility of vaporization of liquid refrigerant while suppressing two-layer separation between the liquid refrigerant and oil by stirring mixed oil in a casing.

Still another aspect of the present disclosure is to provide a scroll compressor capable of preventing an occurrence of an oil supply interruption by preventing an oil level from dropping sharply near an opening of an oil supply pipe while stirring mixed oil in a casing.

To achieve these and other advantages and in accordance with the purpose of the present invention, as embodied and broadly described herein, there is provided a scroll compressor including a casing having an oil storage space in which oil is stored, an oil supply pipe through which the oil stored in the oil storage space is sucked and supplied to a compression unit, and an oil circulation pipe communicating between the storage space and the compression unit. The oil circulation pipe may have both sides opened so that one end is connected to a lower portion of the oil storage space and another end communicates with a refrigerant suction space of the compression unit. Accordingly, liquid refrigerant and oil accumulated in the lower portion of the oil storage space can circulate to the compression unit to be discharged into the inner space of the casing. Then, liquid refrigerant and oil at an intermediate temperature, accumulated in the oil storage space, may be compressed in the compression unit and reheated so as to be discharged into the inner space of the casing, thereby increasing temperature of the inner space of the casing. As the internal temperature of the casing rises rapidly, the oil within the casing can rapidly reach a saturation temperature so as to effectively suppress a two-layer separation phenomenon between the refrigerant and the oil, thereby increasing concentration of oil to be supplied.

In addition, one end of the oil circulation pipe communicating with the oil storage space may be disposed lower than one end of the oil supply pipe through which the oil is sucked. Accordingly, the liquid refrigerant and oil stored in the oil storage space may be sucked into the oil circulation pipe before flowing into the oil supply pipe. This may prevent the oil around the oil supply pipe from being discharged through the compression unit together with the liquid refrigerant.

In addition, an oil circulation valve may be provided in the middle of the oil circulation pipe to communicate or block the oil storage space and the refrigerant suction space with or from each other according to an oil level of the oil storage space. The oil circulation valve may be opened when an oil level detected by an oil level sensor is higher than a height of the oil level sensor, and closed when the detected oil level is lower than the height of the oil level sensor. This may result in preventing a stop of an oil supply due to an excessively lowered oil level of the oil storage space.

In addition, the oil level sensor may be disposed higher than one end of the oil supply pipe. This may result in preventing a stop of an oil supply due to the oil level of the oil storage space being lowered below the one end of the oil supply pipe.

In addition, the liquid refrigerant moved through the oil circulation pipe may be introduced into the refrigerant suction space through an accumulator. Accordingly, the temperature rise in the oil storage space can be further accelerated.

The oil circulation valve may be opened or closed according to the temperature of the oil storage space detected by the temperature sensor. The oil circulation valve may be opened when the temperature detected by the temperature sensor is lower than a preset reference temperature, and closed when the detected temperature is equal to or higher than the preset reference temperature. Accordingly, even when the temperature of the oil storage space is equal to or higher than the reference temperature, the liquid refrigerant and oil in the oil storage space can be prevented from moving to the oil circulation pipe. This may result in preventing a stop of an oil supply due to an excessively lowered oil level of the oil storage space.

The oil circulation valve may be opened and closed by a temperature sensor that detects a temperature of a discharge space. Accordingly, a separate temperature sensor may not be required in the oil storage space, thereby reducing a manufacturing cost of the compressor.

At least one stirring blade may protrude from an outer circumferential surface of the oil supply pipe. The at least one stirring blade may extend along an extending direction of the oil supply pipe. With the configuration, the liquid refrigerant and oil stored in the oil storage space can be mixed together so as to prevent an occurrence of two-layer separation between the liquid refrigerant and the oil. Simultaneously, the liquid refrigerant saturated in the oil can be induced to be rapidly vaporized, thereby increasing concentration of oil to be sucked.

In addition, at least one stirring blade may be inclined at a predetermined angle with the extending direction of the oil supply pipe. The at least one stirring blade may be formed in a spiral shape surrounding the outer circumferential surface of the oil supply pipe clockwise or counterclockwise along the extending direction of the oil supply pipe. This can further increase a stirring effect of the liquid refrigerant and the oil.

In addition, a lower end of the at least one stirring blade may be disposed higher than the lower end of the oil supply pipe. This structure may prevent the oil in the oil storage space from being pushed to an edge of the oil storage space by centrifugal force due to the stirring blade, thereby preventing an instantaneous stop of an oil supply due to an excessively lowered oil level around the oil supply pipe. Also, reduction of an oil supply due to excessive eddy currents formed around an opening of the oil supply pipe can be prevented.

A distance between a side portion of the stirring blade facing its protruding direction and the outer circumferential surface of the oil supply pipe may gradually decrease along the extending direction of the oil supply pipe. Accordingly, when the oil level of the oil storage space is lowered below a predetermine level, a contact area between the stirring blade and the oil stored in the oil storage space may decrease. As a result, the oil level of the oil storage space can be prevented from being excessively lowered. Even in this case, interruption of an oil supply due to excessive eddy currents formed around the opening of the oil supply pipe can be prevented.

At least one stirring blade may have both ends spaced apart from each other in the extending direction of the oil supply pipe and coupled to the outer circumferential surface of the oil supply pipe, respectively. Accordingly, a contact area between the stirring blade and the oil stored in the oil storage space can be reduced, and the interruption of the oil supply due to the excessive eddy currents formed around the opening of the oil supply pipe can also be prevented.

At least one stirring blade may have one end coupled to the outer circumferential surface of the oil supply pipe, and another end formed as a free end. With the structure, a contact area between the stirring blade and the oil stored in the oil storage space can be reduced, and the interruption of the oil supply due to the excessive eddy currents formed around the opening of the oil supply pipe can be prevented.

In addition, a scroll compressor according to an implementation of the present disclosure may include a casing, a motor unit, a fixed scroll, an orbiting scroll, a rotating shaft, a refrigerant suction pipe, an oil circulation pipe, an oil circulation valve, and a control unit. The casing may have an inner space, and an oil storage space may be defined in a lower portion of the inner space. The motor unit may be provided in the inner space of the casing. The fixed scroll may be provided at one side of the motor unit in an axial direction in the inner space of the casing. The orbiting scroll may be engaged with the fixed scroll to define a compression chamber together with the fixed scroll while performing an orbiting motion. The rotating shaft may have one end coupled to the motor unit and another end coupled to the orbiting scroll. The refrigerant suction pipe may be connected to the compression chamber through the casing. The oil circulation pipe may have one end connected to the oil storage space through the casing and another end connected to a suction passage for supplying refrigerant to the compression chamber from outside of the casing. The oil circulation valve may be provided between the both ends of the oil circulation pipe to selectively open or close the oil circulation pipe. The control unit may be configured to control the oil circulation valve to be opened or closed.

The scroll compressor may further include an oil level sensor disposed in the casing to detect an oil level of oil stored in the oil storage space. The control unit may control the oil circulation valve to be open when the oil level detected by the oil level sensor is higher than or equal to a preset value, while controlling the oil circulation valve to be closed when the detected oil level is lower than the preset value.

The oil level sensor may be installed at a position higher than or equal to one end of the oil circulation pipe.

Here, an oil supply pipe may be coupled to a lower end of the rotating shaft to extend in the axial direction, and the one end of the oil circulation pipe may be disposed at a position lower than or equal to an end of the oil supply pipe.

The scroll compressor may further include a temperature sensor disposed in the casing to detect an internal temperature of the inner space of the casing. The control unit may control the oil circulation valve to be opened when the internal temperature of the casing detected by the temperature sensor is lower than or equal to a preset temperature, while controlling the oil circulation valve to be closed when the detected internal temperature is higher than the preset temperature.

The preset temperature of the temperature sensor may be in a range of 30° C. to 35° C. when the temperature sensor is installed in the casing between a discharge cover and the oil storage space, while being in a range of 40° C. to 45° C. when the temperature sensor is installed in a discharge space.

The casing may be further provided therein with an oil level sensor configured to detect an oil level of oil stored in the oil storage space, and a temperature sensor configured to detect an internal temperature of the inner space of the casing. The oil level sensor may be disposed in the oil storage space, and the temperature sensor may be disposed in a space opposite to the oil level sensor based on the motor unit.

The oil level sensor and the temperature sensor may be electrically connected to the control unit, respectively, and the control unit may control the oil circulation valve by receiving at least one of an oil level detected by the oil level sensor and a temperature detected by the temperature sensor.

Here, an oil supply pipe may be coupled to a lower end of the rotating shaft to extend in the axial direction, and at least one stirring blade may be provided on an outer circumferential surface of the oil supply pipe.

The stirring blade may extend in a lengthwise direction of the oil supply pipe.

An oil level sensor may be installed inside the casing, and one end of the stirring blade in a lengthwise direction may be located higher than the oil level sensor.

The stirring blade may be formed such that a protruded width decreases toward an end of the oil supply pipe.

The stirring blade may extend at a predetermined angle with a lengthwise direction of the oil supply pipe.

The stirring blade may be formed in a spiral shape surrounding the outer circumferential surface of the oil supply pipe clockwise or counterclockwise along a lengthwise direction of the oil supply pipe.

The stirring blade may have both ends coupled to both end portions of the outer circumferential surface of the oil supply pipe in a lengthwise direction, and the both ends of the stirring blade may be spaced apart from the outer circumferential surface of the oil supply pipe so as to define an oil passage in the stirring blade.

The stirring blade may have one end coupled to the outer circumferential surface of the oil supply pipe and another end forming a free end.

To achieve those aspects and other advantages of the present disclosure, there is provided a method for controlling the scroll compressor, the method including sensing, by an oil level sensor, oil level information related to an oil storage space, sensing, by a temperature sensor, temperature information related to the oil storage space, calculating, by the control unit, opening/closing information using the detected oil level information and temperature information, and opening or closing the oil circulation valve depending on the calculated opening/closing information.

The calculating the opening/closing information may include comparing the detected oil level information with preset reference height information, and comparing the detected temperature information with preset reference temperature information.

The comparing with the preset reference height information may include calculating, by the control unit, the opening/closing information as information for opening the oil circulation valve when the oil level information is higher than or equal to a height value of the preset reference height information, and calculating, by the control unit, the opening/closing information as information for closing the oil circulation valve when the oil level information is lower than the height value of the preset reference height information.

The comparing with the reference temperature information may include calculating, by the control unit, the opening/closing information as information for opening the oil circulation valve when the temperature information is lower than a temperature value of the preset reference temperature information, and calculating, by the control unit, the opening/closing information as information for closing the oil circulation valve when the temperature information is higher than or equal to the temperature value of the preset reference temperature information.

DETAILED DESCRIPTION OF THE IMPLEMENTATIONS

Hereinafter, a scroll compressor according to an implementation of the present disclosure will be described in detail with reference to the accompanying drawings.

In the following description, a description of some components may be omitted to clarify features of the present disclosure.

1. Definition of Terms

The term "electrical connection" used in the following description means that one component is electrically connected to another component or is connected to enable information communication with another component. The electrical connection may be enabled by conductive wires, communication cables, or the like.

The term "upper side or top" used in the following description means a direction away from a support surface that supports a scroll compressor according to an implementation of the present disclosure.

The term "lower side or bottom" used in the following description means a direction toward the support surface that supports the scroll compressor according to the implementation of the present disclosure.

The term "axial direction" used in the following description means a lengthwise direction of a rotating shaft. The axial direction may be understood as an up and down (or vertical) direction.

The term "radial direction" used in the following description means a direction intersecting with the rotating shaft.

In addition, a description will be given of a bottom compression type scroll compressor which is a vertical type scroll compressor with a motor unit and a compression unit arranged in a vertical direction in a manner that the compression unit is located below the motor unit.

In addition, a description will be given of a high-pressure type scroll compressor which is a bottom compression type and has a refrigerant suction pipe directly connected to a compression unit to define a suction passage and a refrigerant discharge pipe communicating with an inner space of a casing.

2. Description of Refrigeration Cycle of Scroll Compressor 10 According to Implementation FIG. 1 is a system diagram illustrating a refrigeration cycle apparatus to which a bottom compression type scroll compressor 10 in accordance with one implementation of the present disclosure is applied.

Figure 1:
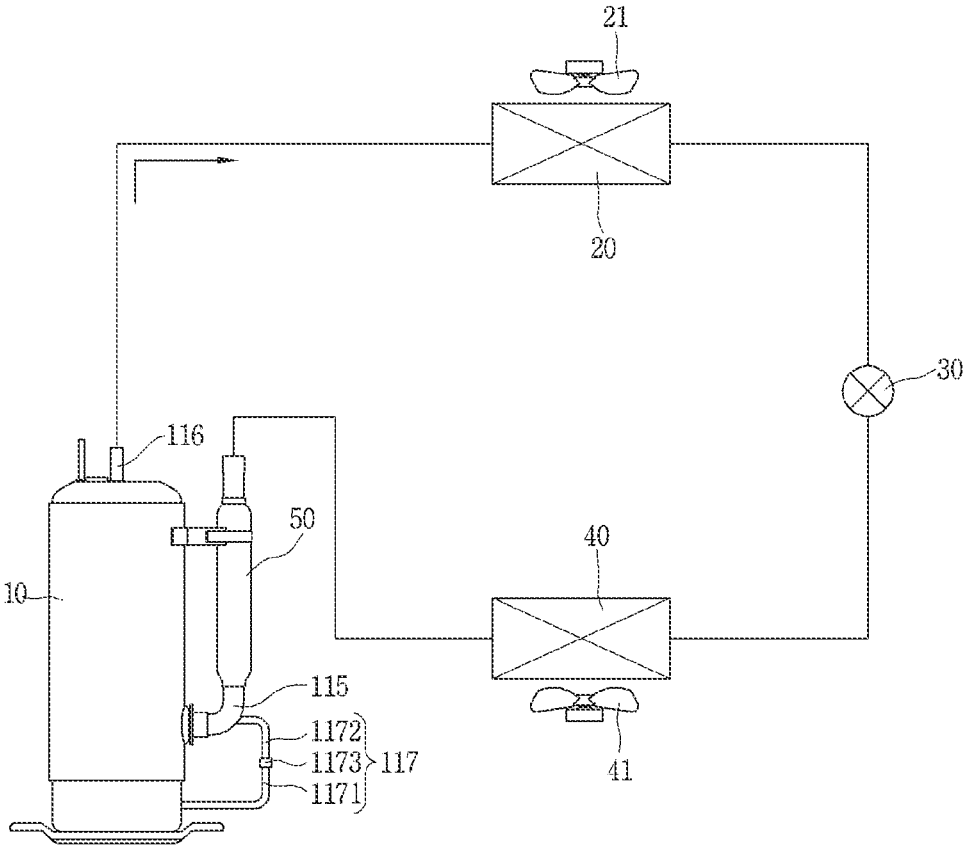
FIG. 1 is a system diagram illustrating a refrigeration cycle apparatus to which a bottom compression type scroll compressor in accordance with one implementation of the present disclosure is applied.

Referring to FIG. 1, a refrigeration cycle apparatus to which the scroll compressor 10 according to the implementation is applied may be configured such that a compressor 10, a condenser 20, an expansion apparatus 30, and an evaporator 40 define a closed loop.

The closed loop may be configured as follows.

The condenser 20, the expansion apparatus 30, and the evaporator 40 may be sequentially connected to a refrigerant discharge pipe 116 of the compressor 10 through which compressed refrigerant is discharged, and a discharge side of the evaporator 40 may be connected to a suction side of the compressor 10.

Accordingly, the refrigerant compressed in the compressor 10 may be discharged toward the condenser 20, and then sucked back into the compressor 10 sequentially through the expansion apparatus 30 and the evaporator 40. The series of processes may be repeatedly carried out.

3. Description of Structure of Scroll Compressor 10 According to One Implementation Referring to FIGS. 2 and 3, the scroll compressor 10 according to this implementation may include a casing 110 having an inner space. A driving motor 120 may be disposed in an upper portion of the casing 110. A main frame 130, an orbiting scroll 150, a fixed scroll 140, and a discharge cover 160 may be sequentially disposed below the driving motor 120.

Typically, the driving motor 120 may configure a motor unit that receives electrical energy and converts the electrical energy into mechanical energy. The main frame 130, the orbiting scroll 150, the fixed scroll 140, and the discharge cover 160 may configure a compression unit that compresses refrigerant by receiving the mechanical energy from the driving motor 120.

The motor unit may be coupled to an upper end of a rotating shaft 125 to be explained later, and the compression unit may be coupled to a lower end of the rotating shaft 125. Accordingly, the compressor 10 may have the bottom compression type structure described above, and the compression unit may be connected to the motor unit by the rotating shaft 125 to be operated by a rotational force of the motor unit.

(1) Description of Casing 110

Figure 2:
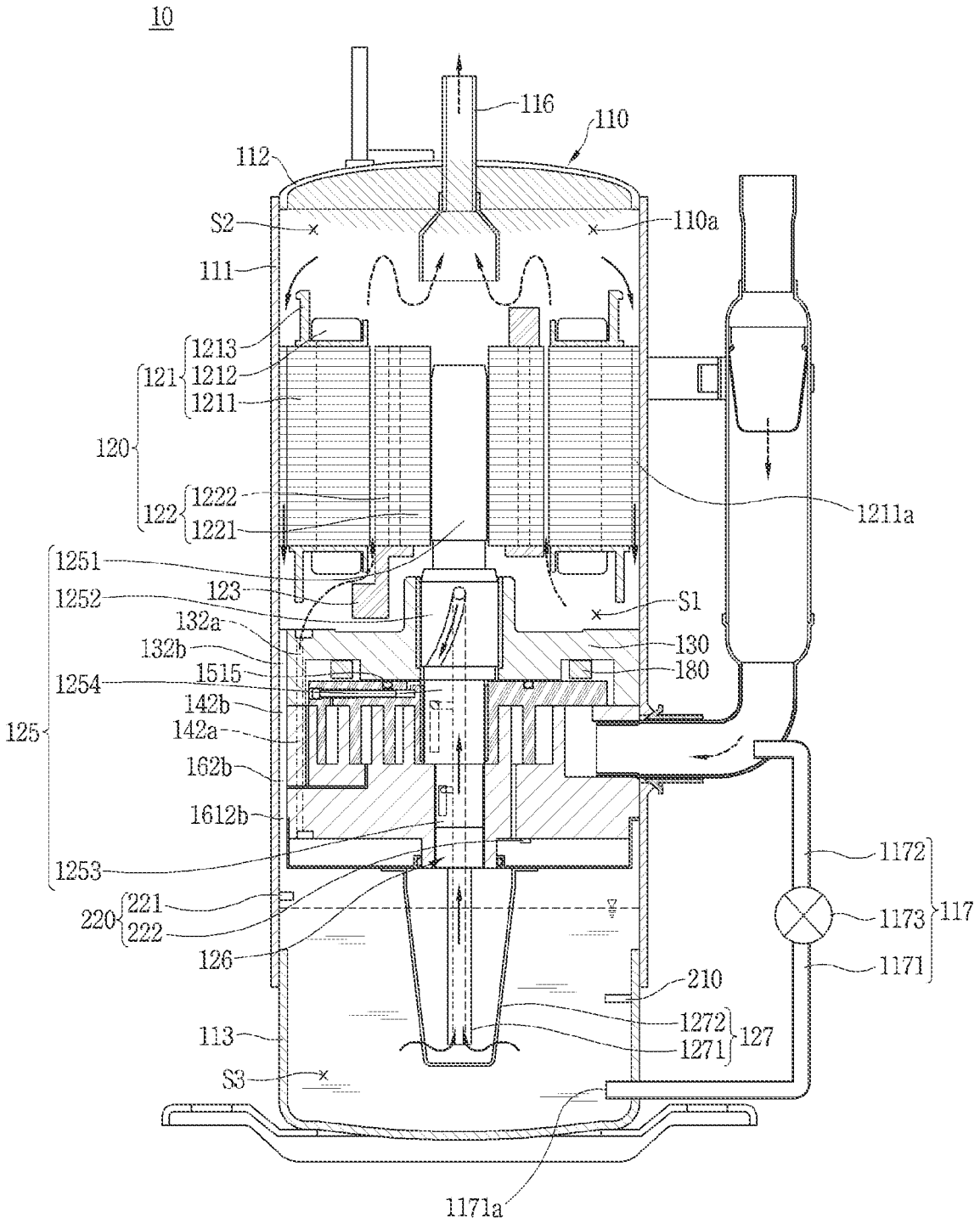
FIG. 2 is a cross-sectional view illustrating the scroll compressor according to FIG. 1.

Referring to FIG. 2, the casing 110 may include a cylindrical shell 111, an upper shell 112, and a lower shell 113.

The cylindrical shell 111 may be formed in a cylindrical shape with both upper and lower ends open.

The upper shell 112 may be coupled to an upper end portion of the cylindrical shell 111. Accordingly, the upper opening of the cylindrical shell 111 may be covered.

In addition, the lower shell 113 may be coupled to a lower end portion of the cylindrical shell 111. Accordingly, the lower opening of the cylindrical shell 111 may be covered.

That is, both of the upper and lower end portions of the cylindrical shell 111 may be coupled to the upper shell 112 and the lower shell 113, respectively, and the upper shell 112, the cylindrical shell 111, and the lower shell 113 which are coupled together may define an inner space 110*a* of the casing 110. The inner space 110*a* may be hermetically sealed.

The sealed inner space 110*a* of the casing 110 may be divided into a lower space S1, an upper space S2, an oil storage space S3, and a discharge space S4.

The lower space S1 and the upper space S2 may be defined above the main frame 130 and the oil storage space S3 and the discharge space S4 may be defined below the main frame 130.

The lower space S1 may refer to a space defined between the driving motor 120 and the main frame 130, and the upper space S2 may refer to a space above the driving motor 120. The lower space S1 may define a discharge space, and the upper space S2 may define an oil separation space.

The oil storage space S3 may refer to a lower space of a discharge cover 160, and the discharge space S4 may refer to a space between the discharge cover 160 and the fixed scroll 140. Refrigerant discharged to the discharge space S4 may flow to the lower space S1.

The driving motor 120 and the main frame 130 may be fixedly inserted into the cylindrical shell 111.

Grooves extending in a vertical (or up and down) direction may be radially recessed into an outer circumferential surface of the driving motor 120 and an outer circumferential surface of the main frame 130, respectively.

In the state where the driving motor 120 and the main frame 130 are coupled to the cylindrical shell 111, predetermined spaces with upper and lower sides open may be defined between an inner circumferential surface of the cylindrical shell 111 and the grooves of the driving motor 120 and the main frame 130. Oil may move along the defined spaces. This will be described again later together with an oil recovery passage.

A refrigerant suction pipe 115 defining a suction passage may be coupled through a side of the cylindrical shell 111. Accordingly, the refrigerant suction pipe 115 may be radially coupled through the cylindrical shell 111 forming the casing 110.

The refrigerant suction pipe 115 may be formed in an L-like shape. One end of the refrigerant suction pipe 115 may be directly coupled to a suction through hole 142*c* of a fixed scroll 140, which configures the compression unit, through the cylindrical shell 111. Accordingly, refrigerant may be introduced into a compression chamber V through the refrigerant suction pipe 115.

Another end of the refrigerant suction pipe 115 may be connected to an accumulator 50 which defines a suction passage outside the cylindrical shell 111. The accumulator 50 may be connected to an outlet side of the evaporator 40 through a refrigerant pipe. Accordingly, while refrigerant flowing from the evaporator 40 to the accumulator 50, liquid refrigerant may be separated in the accumulator 50, and only gaseous refrigerant may be directly introduced into the compression chamber through the refrigerant suction pipe 115.

A terminal bracket (not shown) may be coupled to an upper portion of the cylindrical shell 111, namely, the upper shell 112, and a terminal (not shown) for transmitting external power to the driving motor 120 may be coupled through the terminal bracket.

A refrigerant discharge pipe 116 may be coupled through an upper portion of the upper shell 112 to communicate with the inner space 110*a* of the casing 110. The refrigerant discharge pipe 116 may correspond to a passage through which compressed refrigerant discharged from the compression unit to the inner space 110*a* of the casing 110 externally flows toward the condenser 20.

The refrigerant discharge pipe 116 may be provided therein with an oil separation device (not shown) for separating oil from the refrigerant discharged from the compressor 10 to the condenser 20, or a check valve (not shown) for suppressing refrigerant discharged from the compressor 10 from flowing back into the compression 10.

One end portion of an oil circulation pipe 117 to be explained later may be coupled through a lower portion of the lower shell 113 in the radial direction. Both ends of the oil circulation pipe 117 may be open, and another end portion of the oil circulation pipe 117 may be coupled through the refrigerant suction pipe 115. Accordingly, the lower portion of the oil storage space S3 and the refrigerant suction pipe 115 may communicate with each other.

(2) Description of Driving Motor 120

The driving motor 120 may be disposed at an upper portion in the inner space 110*a* of the casing 110.

The driving motor 120 according to this implementation may include a stator 121 and a rotor 122. The stator 121 may be fixedly inserted into the inner circumferential surface of the cylindrical shell 111, and the rotor 122 may be rotatably disposed in the stator 121.

The stator 121 may include a stator core 1211 and a stator coil 1212.

The stator core 1211 may be formed in a cylindrical shape and may be shrink-fitted to the inner circumferential surface of the cylindrical shell 111. A plurality of recessed surfaces may be formed in a D-cut shape recessed into an outer circumferential surface of the stator core 1211 along an axial direction.

The recessed surface 1211*a* may be provided in plurality and may be located at predetermined intervals along a circumferential direction.

As the stator core 1211 is coupled to the inner circumferential surface of the cylindrical shell 111, upper and lower sides may be open between the recessed surfaces 1211*a* and the inner circumferential surface of the cylindrical shell 111, thereby defining a first oil recovery passage (not shown).

Accordingly, oil separated from refrigerant in the upper space S2 may move to the lower space S1 through the first oil recovery passage, and then recovered into the oil storage space S3 through a second oil recovery passage (not shown) defined between outer circumferential surfaces of the fixed scroll 140 and the discharge cover 160 and the inner circumferential surface of the cylindrical shell 111.

The stator coil 1212 may be wound around the stator core 1211 and may be electrically connected to an external power source through a terminal (not shown) that is coupled through the casing 110. An insulator 1213, which is an insulating member, may be inserted between the stator core 1211 and the stator coil 1212.

The insulator 1213 may extend long to both sides in the axial direction to accommodate a bundle of the stator coil 1212 in the radial direction, and a portion of the insulator 1213 extending downward may configure an oil separation portion (no reference numeral given) to prevent refrigerant discharged into the lower space S1 from being mixed with oil recovered from the upper space S2.

The rotor 122 may include a rotor core 1221 and permanent magnets 1222.

The rotor core 1221 may be formed in a cylindrical shape to be accommodated in a space formed in a central portion of the stator core 1211.

Specifically, the rotor core 1221 may be rotatably inserted into the central space of the stator core 1211 with a preset gap from an inner side (inner surface) of the stator core 1211. The permanent magnets 1222 may be embedded in the rotor core 1222 at preset intervals along the circumferential direction.

In addition, a balance weight 123 may be coupled to a lower end of the rotor core 1221. Alternatively, the balance weight 123 may be coupled to a bearing portion 1251 of a rotating shaft 125 to be described later.

The rotating shaft 125 may be coupled to the center of the rotor 122. An upper end portion of the rotating shaft 125 may be press-fitted into the rotor 122, and a lower end portion may be rotatably inserted into the main frame 130 to be supported in the radial direction.

The main frame 130 may be provided with a main bearing 171 configured as a bush bearing to support the lower end portion of the rotating shaft 125. Accordingly, a portion, which is inserted into the main frame 130, of the lower end portion of the rotating shaft 125 may smoothly rotate inside the main frame 130.

The rotating shaft 125 may transfer a rotational force of the driving motor 120 to an orbiting scroll 150 constituting the compression unit. Accordingly, the orbiting scroll 150 eccentrically coupled to the rotating shaft 125 may perform an orbiting motion with respect to the fixed scroll 140.

Figure 3:
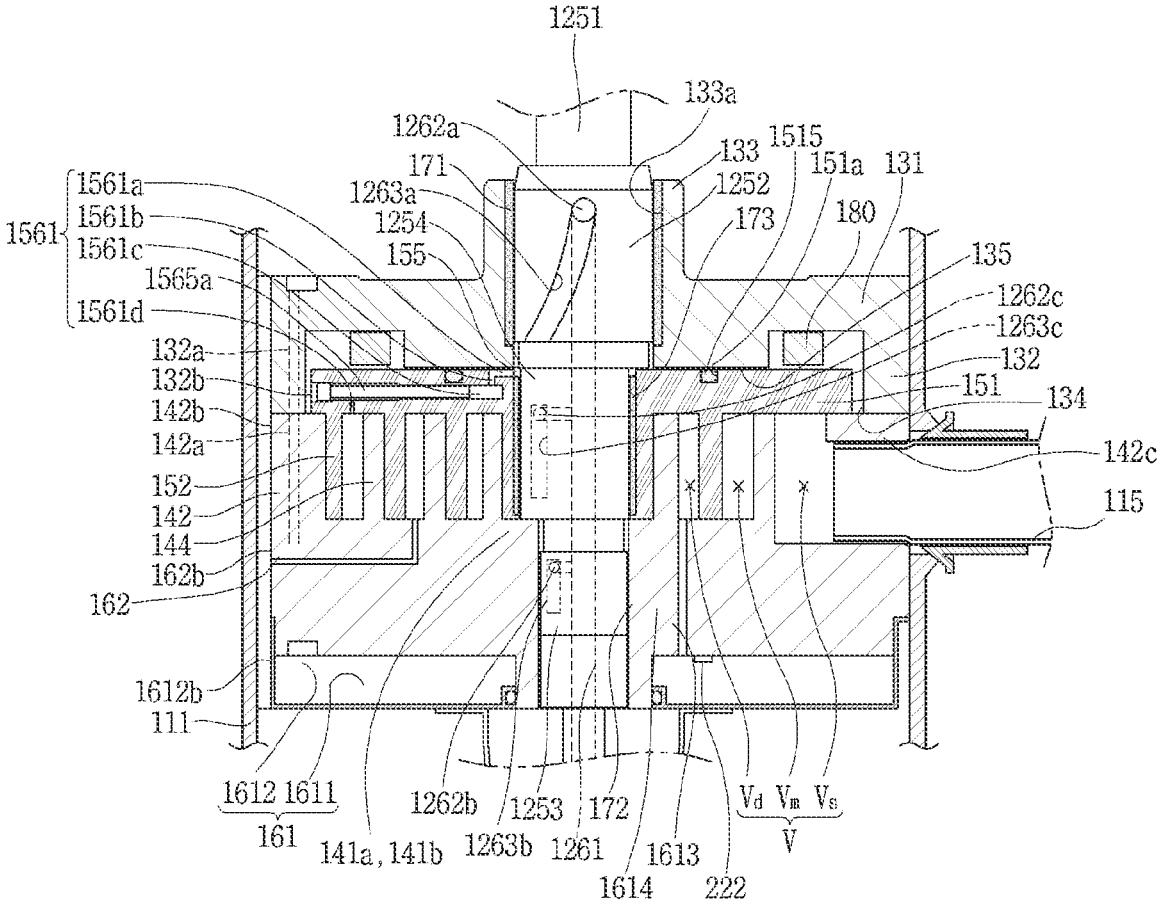
FIG. 3 is an enlarged cross-sectional view of a compression unit according to FIG. 2.

Referring to FIGS. 2 and 3, the rotating shaft 125 may include a shaft portion 1251, a first bearing portion 1252, a second bearing portion 1253, and an eccentric portion 1254.

The shaft portion 1251 may be an upper portion of the rotating shaft 125 and may be formed in a cylindrical shape. The shaft portion 1251 may be partially press-fitted into the rotor 122.

The first bearing portion 1252 may be a portion extending from a lower end the shaft portion 1251. The first bearing portion 1252 may be inserted into a main bearing hole 133*a* of the main frame 130 to be described later so as to be supported in the radial direction.

The second bearing portion 1253 may be a lower portion of the rotating shaft 125. The second bearing portion 1253 may be inserted into a sub bearing hole 143*a* of the fixed scroll 140 to be described later so as to be supported in the radial direction.

A central axis of the second bearing portion 1253 and a central axis of the first bearing portion 1252 may be aligned on the same line. That is, the first bearing portion 1252 and the second bearing portion 1253 may have the same central axis.

The eccentric portion 1254 may be formed between a lower end of the first bearing portion 1252 and an upper end of the second bearing portion 1253. The eccentric portion 1254 may be inserted into a rotating shaft coupling portion 153 of the orbiting scroll 150 to be described later.

The eccentric portion 1254 may be eccentric with respect to the first bearing portion 1252 or the second bearing portion 1253 in the radial direction. That is, the central axis of the first bearing portion 1252 and the second bearing portion 1253 and a central axis of the eccentric portion 1254 may be inconsistently aligned with each other.

Accordingly, when the rotating shaft 125 rotates, the orbiting scroll 150 may perform an orbiting motion with respect to the fixed scroll 140.

Meanwhile, the rotating shaft 125 may be provided with an oil supply passage 126 formed therein to supply oil to the first bearing portion 1252, the second bearing portion 1252, and the eccentric portion 1254. The oil supply passage 126 may include an inner oil passage 1261 formed in the rotating shaft along the axial direction.

As the compression unit is located below the motor unit 20, the inner oil passage 1261 may be formed in a grooving manner from the lower end of the rotating shaft 125 approximately to a lower end or a middle height of the stator 121 or to a position higher than an upper end of the first bearing portion 1252. Although not illustrated, the inner oil passage 1261 may alternatively be formed through the rotating shaft 125 in the axial direction.

In addition, an oil feeder 127 for pumping up oil filled in the oil storage space S3 may be coupled to the lower end of the rotating shaft 125, namely, a lower end of the second bearing portion 1253. The oil feeder 127 may include an oil supply pipe 1271 inserted into the inner oil passage 1261 of the rotating shaft 125, and a blocking member 1272 accommodating the oil supply pipe 1271 to block an introduction of foreign materials. The oil supply pipe 1271 may extend downward through the discharge cover 160 to be immersed in the oil filled in the oil storage space S3.

The rotating shaft 125 may be provided with a plurality of oil supply holes communicating with the inner oil passage 1261 to guide oil moving upward along the inner oil passage 1261 toward the first and second bearing portions 1252 and 1253 and the eccentric portion 1254.

The plurality of oil supply holes may penetrate between an inner circumferential surface of the inner oil passage 1261 and outer circumferential surfaces of the first and second bearing portions 1252 and 1253 and the eccentric portion 1254.

The plurality of oil supply holes may constitute the oil supply passage 126 together with the inner oil passage 1261, and include a first oil hole 1262*a*, a second oil hole 1262*b*, and a third oil hole 1262*c*.

The first oil hole 1262*a* may penetrate between the inner circumferential surface of the inner oil passage 1261 and the outer circumferential surface of the first bearing portion 1252, and the second oil hole 1262*b* may penetrate between the inner circumferential surface of the inner oil passage 1261 and the outer circumferential surfaces of the second bearing portion 1253.

In addition, the third oil hole 1262*c* may penetrate between the inner circumferential surface of the inner oil passage 1261 and the outer circumferential surface of the eccentric portion 1254.

The second oil hole 1262*b*, the third oil hole 1262*c*, and the first oil hole 1262*a* may sequentially be arranged from the bottom to the top.

A first oil groove 1263*a* may be formed on the outer circumferential surface of the first bearing portion 1252. The first oil groove 1263*a* may communicate with the inner oil passage 1261 through the first oil hole 1262*a*.

A second oil groove 1263*b* may be formed on the outer circumferential surface of the second bearing portion 1253 of the rotating shaft 125. The second oil groove 1263*b* may communicate with the inner oil passage 1261 through the second oil hole 1262*b*.

In addition, a third oil groove 1263*c* may be formed on the outer circumferential surface of the eccentric portion 1254. The third oil groove 1263*c* may communicate with the inner oil passage 1261 through the third oil hole 1262*c*.

Since the first, second and third oil grooves 1263*a*, 1263*b*, and 1263*c* extend in the vertical direction, oil supplied to the first, second and third oil grooves 1263*a*, 1263*b*, 1263*c* may be evenly spread on the outer circumferential surfaces of the first and second bearing portions 1252 and 1253 and the eccentric portion 1254 in the vertical direction.

Here, oil flowing to the first oil groove 1263*a* of the first bearing portion 1252 or oil flowing to the third oil groove 1263*c* of the eccentric portion 1254 may move to an oil accommodating portion 155 to be described later.

The oil moved to the oil accommodating portion 155 may be supplied to the compression chamber through a compression chamber oil supply hole 156 provided in the orbiting scroll 150 to be described later. The compression chamber oil supply hole 156 will be described again later together with the orbiting scroll.

(3) Description of Compression Unit

Figure 4:
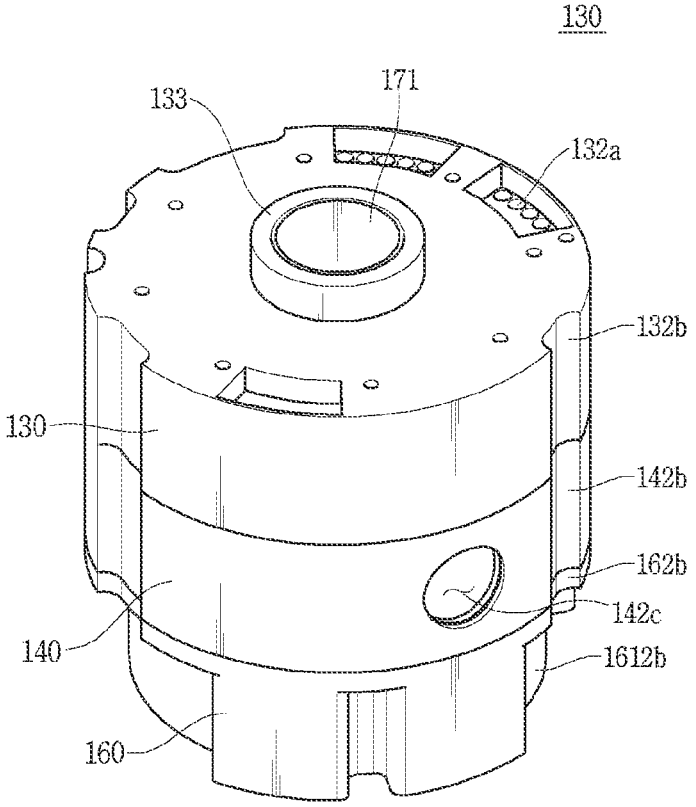
FIG. 4 is an assembled perspective view illustrating the compression unit according to FIG. 2.
Figure 5:
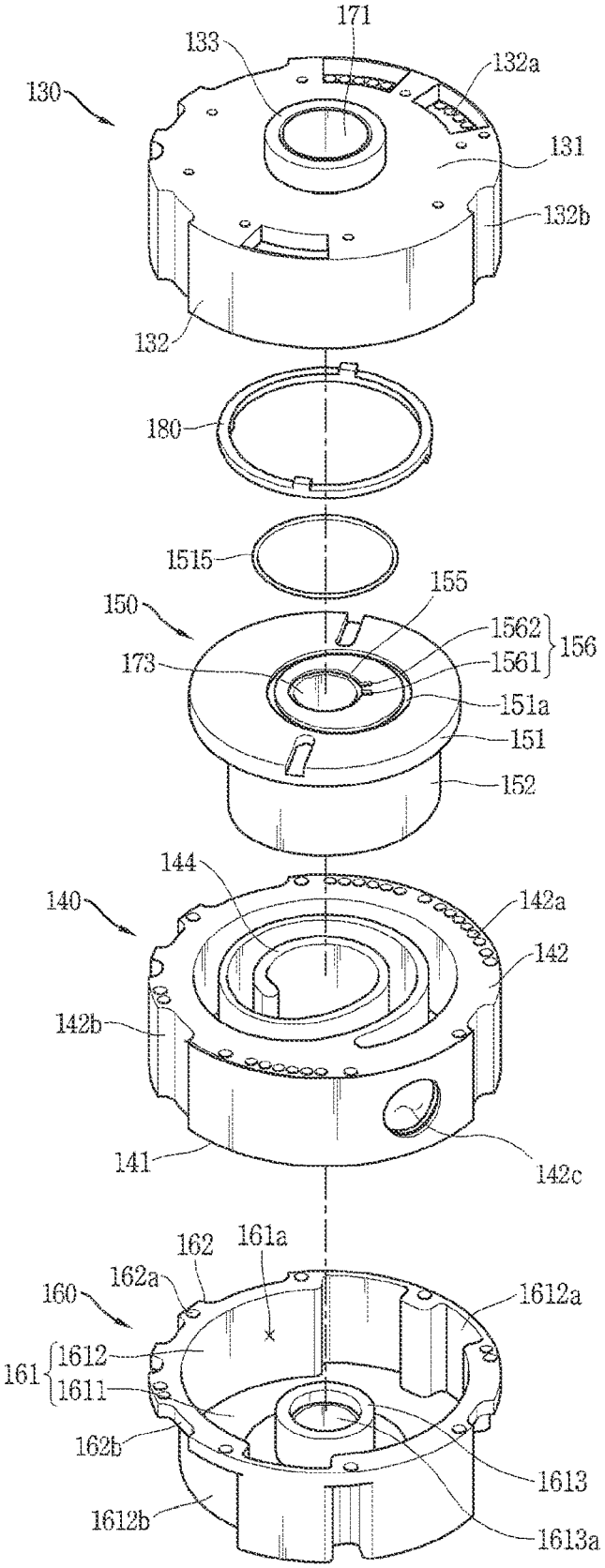
FIG. 5 is an exploded perspective view of the compression unit according to FIG. 2, viewed from the top.
Figure 6:
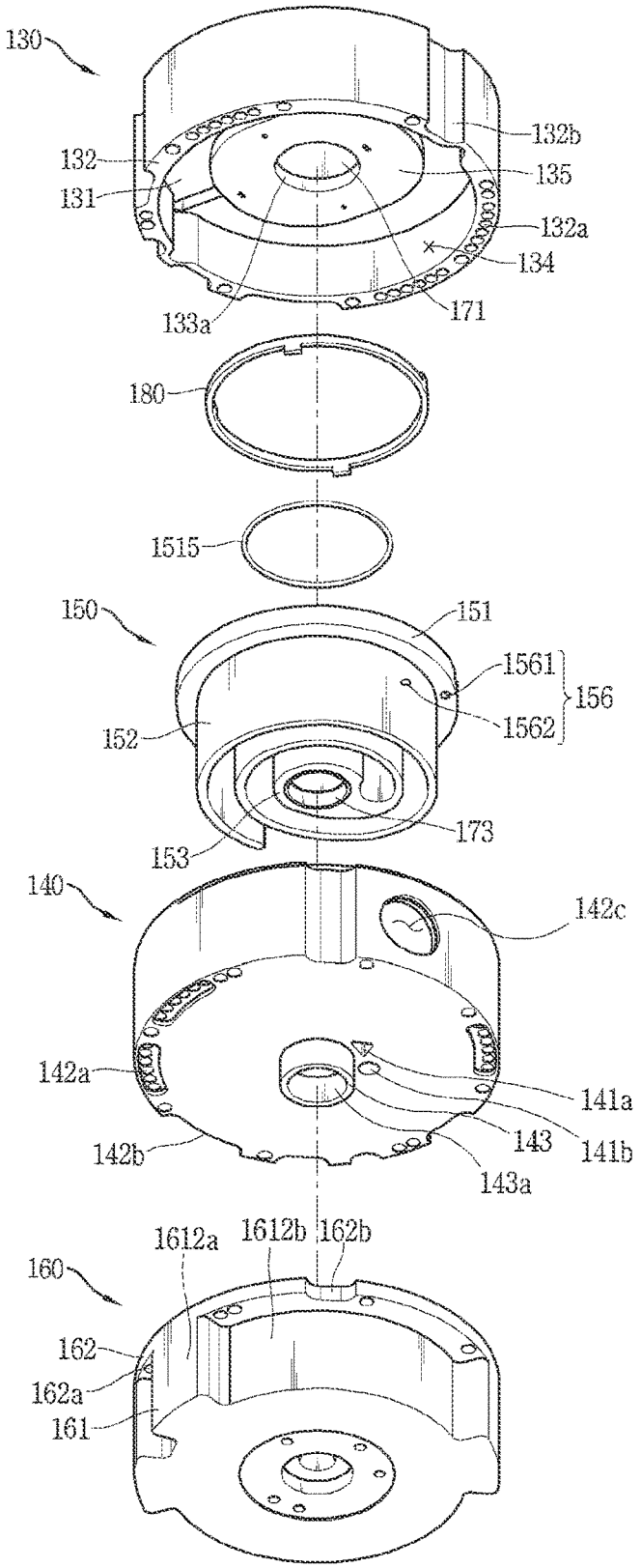
FIG. 6 is an exploded perspective view of the compression unit according to FIG. 2, viewed from the bottom.

Referring to FIGS. 4 to 6, the main frame 130 according to the implementation may include a frame end plate 131, a frame side wall 132, a main bearing portion 133, a scroll accommodating portion 134, and a scroll support portion 135.

The frame end plate 131 may be formed in an annular shape. The frame side wall 132 may extend downward in a cylindrical shape from an edge of a lower surface of the frame end plate 131. An outer circumferential surface of the frame side wall 132 may be fixed to the inner circumferential surface of the cylindrical shell 111 in a shrink-fitting manner or a welding manner.

Accordingly, a space above the frame end plate 131 may be isolated. That is, the lower space S1 may be defined above the frame end plate 131.

In addition, the main frame 130 may include a scroll accommodating portion 134 that is a space surrounded by an inner circumferential surface of the frame side wall 132 and a lower surface of the frame end plate 131.

The orbiting scroll 150 to be described later may be accommodated in the scroll accommodating portion 134 so as to perform an orbiting motion.

To this end, an inner diameter of the frame side wall 132 may be greater than an outer diameter of an orbiting end plate 151 to be described later.

A plurality of frame discharge holes 132*a* may be formed through the frame side wall 132 in the vertical (up/down) direction. The plurality of frame discharge holes 132*a* may be disposed at preset intervals along the circumferential direction.

The frame discharge holes (hereinafter, second discharge holes) 132*a* may be formed at positions corresponding to positions of scroll discharge holes 142*a* of the fixed scroll 140 to be described later. Accordingly, when the main frame 130 and the fixed scroll 140 are coupled to each other, the second discharge holes 132*a* may communicate with the scroll discharge holes 142*a* so as to define a first refrigerant discharge passage (or refrigerant flow path).

Also, a plurality of frame oil recovery grooves (hereinafter, first oil recovery grooves) 132*b* may be formed on an outer circumferential surface of the frame side wall 132 with the second discharge holes 132*a* interposed therebetween.

The plurality of first oil recovery grooves 132*b* may be disposed at preset intervals along the circumferential direction. Accordingly, when the main frame 130 and the cylindrical shell 111 are coupled to each other, the plurality of first oil recovery grooves 132*b* may define predetermined spaces, which have upper and lower sides open, together with the inner circumferential surface of the cylindrical shell 111.

The first oil recovery grooves 132*b* may be located at positions corresponding to positions of scroll oil recovery grooves 142*b* of the fixed scroll 140 to be described later. Accordingly, when the main frame 130 and the fixed scroll 140 are coupled to each other, the first oil recovery grooves 132*b* may define a second oil recovery flow path together with the scroll oil recovery grooves 142*b* of the fixed scroll 140.

The main bearing portion 133 may protrude upward from an upper surface of a central part of the frame end plate 131 toward the driving motor 120.

The main bearing portion 133 may be provided with a main bearing hole 133*a* formed therethrough in a cylindrical shape along the axial direction. The main bearing 171 configured as the bush bearing may be fixedly inserted into an inner circumferential surface of the main bearing hole 133*a*. The main bearing portion 133 of the rotating shaft 125 may be inserted into the main bearing 171 to be supported in the radial direction.

The orbiting end plate 151 of the orbiting scroll 150 to be described later may be supported in the vertical direction by a lower surface of the frame end plate 131, and an outer circumferential surface of the orbiting end plate 151 may be accommodated in the frame side wall 132 with being spaced apart from the inner circumferential surface of the frame side wall 132 by a preset interval (for example, an orbiting radius).

Accordingly, an inner diameter of the frame side wall 132 constituting the scroll accommodating portion 134 may be greater than an outer diameter of the orbiting end plate 151 by the orbiting radius or more.

In addition, the frame side wall 132 defining the scroll accommodating portion 134 may have a height (depth) that is greater than or equal to a thickness of the orbiting end plate 151. Accordingly, while the frame side wall 132 is supported on the upper surface of the fixed scroll 140, the orbiting scroll 150 may perform an orbiting motion in the scroll accommodating portion 134.

The scroll support portion 135 may be formed in an annular shape on the lower surface of the frame end plate 131 that faces the orbiting end plate 151 of the orbiting scroll 150 to be described later. Accordingly, an Oldham ring 180 may be pivotably inserted between an outer circumferential surface of the scroll support portion 135 and the inner circumferential surface of the frame side wall 132.

In addition, the scroll support portion 135 may have a lower surface formed to be flat, so that a back pressure sealing member 1515 provided on the orbiting end plate 151 of the orbiting scroll 150 to be described later is in contact with the lower surface in a sliding manner.

The back pressure sealing member 1515 may be formed in an annular shape, by which an oil accommodating portion 155 may be formed between the scroll support portion 135 and the orbiting end plate 151. Accordingly, oil flowing into the oil accommodating portion 155 through the third oil hole 1262*c* of the rotating shaft 125 may be introduced into the compression chamber V through the compression chamber oil supply hole 156 of the orbiting scroll 150 to be described later. The compression chamber oil supply hole will be described later together with the orbiting scroll 150.

Hereinafter, the fixed scroll 40 will be described.

Referring to FIGS. 4 to 6, the fixed scroll 140 according to the implementation may include a fixed end plate 141, a fixed side wall 142, a sub bearing portion 143, and a fixed wrap 144.

The fixed end plate 141 may be formed in a disk shape having a plurality of concave portions on an outer circumferential surface thereof, and a sub bearing hole 143*a* forming the sub bearing portion 143 to be described later may be formed through a center in the vertical direction. Discharge ports 141*a* and 141*b* may be formed around the sub bearing hole 143*a*. The discharge ports 141*a* and 141*b* may communicate with a discharge chamber Vd so that compressed refrigerant is discharged into a discharge space S4 of the discharge cover 160 to be explained later.

Although not illustrated in an implementation, only one discharge port may be provided to communicate with both of a first compression chamber V1 and a second compression chamber V2 to be described later.

In the illustrated implementation, the first discharge port 141*a* may communicate with the first compression chamber V1 and the second discharge port 141*b* may communicate with the second compression chamber V2.

Accordingly, refrigerant compressed in the first compression chamber V1 and refrigerant compressed in the second compression chamber V2 may be independently discharged through the different discharge ports.

The fixed side wall 142 may extend in an annular shape from an edge of an upper surface of the fixed end plate 141 in the vertical direction. The fixed side wall 142 may be coupled to face the frame side wall 132 of the main frame 130 in the vertical direction.

A plurality of scroll discharge holes (hereinafter, first discharge holes) 142*a* may be formed through the fixed side wall 142 in the vertical direction. The plurality of first discharge holes 142*a* may communicate with the second discharge holes 132*a* in the state in which the fixed scroll 140 is coupled to the cylindrical shell 111.

The first and second discharge holes 142*a* and 132*a* communicating with each other may define a first refrigerant discharge passage. Refrigerant discharged into the discharge space S4 may flow upward through the first refrigerant discharge passage so as to move to the lower space S1.

Scroll oil recovery grooves (hereinafter, second oil recovery grooves) 142*b* may be formed on an outer circumferential surface of the fixed side wall 142.

In the state in which the fixed scroll 140 is coupled to the cylindrical shell 111, the second oil recovery grooves 142*b* may communicate with the first oil recovery grooves 132*b* provided in the main frame 130. The first and second oil recovery grooves 132*b* and 142*b* communicating with each other may constitute a second oil recovery passage having upper and lower sides open, so that oil flowing into the lower space S1 can be guided to the oil storage space S3 through the second oil recovery passage.

In addition, the fixed side wall 142 may be provided with a suction through hole 142*c* formed through the fixed side wall 142 in the radial direction. An end portion of the refrigerant suction pipe 115 inserted through the cylindrical shell 111 may be inserted into the suction through hole 142*c*. Accordingly, refrigerant may be introduced into a compression chamber V through the refrigerant suction pipe 115.

The sub bearing portion 143 may extend from a central part of the fixed end plate 141 toward the discharge cover 160 in the axial direction. The main bearing portion 143 may be provided with a sub bearing hole 143*a* formed therethrough in a cylindrical shape along the axial direction. The main bearing 172 configured as the bush bearing may be inserted into an inner circumferential surface of the sub bearing hole 132.

Therefore, the lower end of the rotating shaft 125 may be inserted into the sub bearing portion 143 of the fixed scroll 140 to be supported in the radial direction, and the eccentric portion 1254 of the rotating shaft 125 may be supported by the upper surface of the fixed end plate 141 defining the surrounding of the sub bearing portion 143 in the axial direction.

The fixed wrap 144 may extend from the upper surface of the fixed end plate 141 toward the orbiting scroll 150 in the axial direction. The fixed wrap 144 may be engaged with an orbiting wrap 152 to be described later to define the compression chamber V. The fixed wrap 144 will be described later together with the orbiting wrap 152.

Hereinafter, the orbiting scroll 150 will be described.

Figure 7:
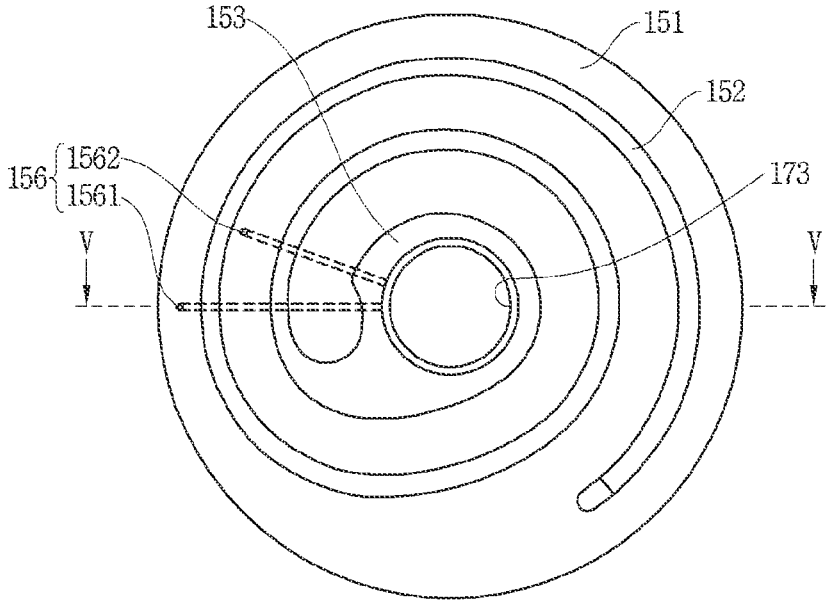
FIG. 7 is a planar view of an orbiting scroll according to FIG. 6.
Figure 8:
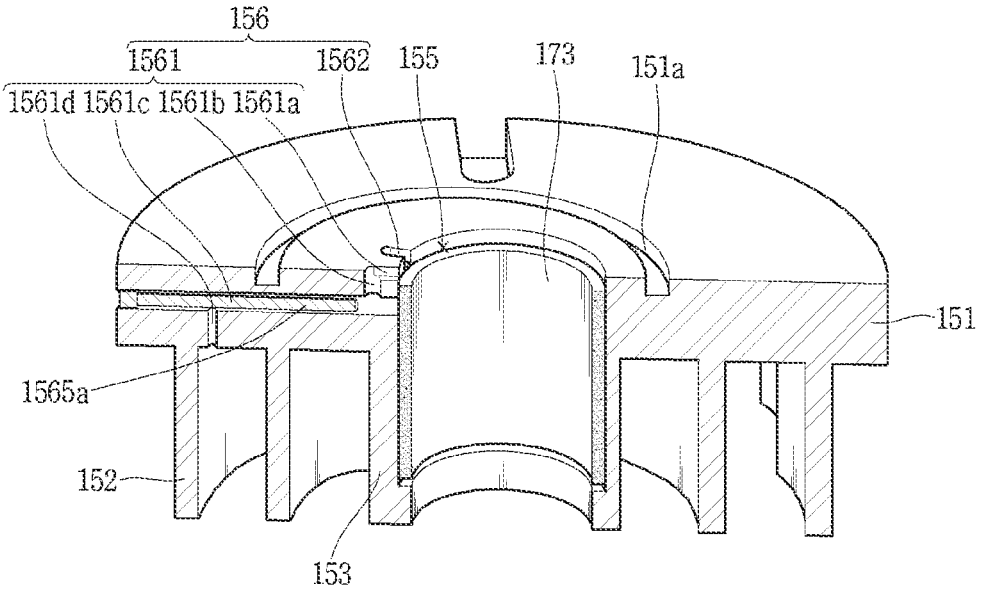
FIG. 8 is a cross-sectional view taken along line V-V of FIG. 7.

FIG. 7 is a planar view illustrating the orbiting scroll in FIG. 5, and FIG. 8 is a cross-sectional view taken along line "V-V" in FIG. 7 for explaining the compression chamber oil supply hole of the orbiting scroll.

Referring to FIGS. 7 and 8, the orbiting scroll 150 according to the implementation may include an orbiting end plate 151, an orbiting wrap 152, and a rotating shaft coupling portion 153.

The orbiting end plate 151 may be formed in a disk shape. A back pressure sealing groove 151*a* into which the back pressure sealing member 1515 is inserted may be formed on an upper surface of the orbiting end plate 151. The back pressure sealing groove 151*a* may be formed at a position facing the scroll support portion 135 of the main frame 130.

The back pressure sealing groove 151*a* may be formed in an annular shape to surround the rotating shaft coupling portion 153 to be described later, and may be formed eccentrically with respect to a central axis of the rotating shaft coupling portion 153.

Accordingly, even if the orbiting scroll 150 performs an orbiting motion, a back pressure chamber having a constant range may be defined between the orbiting scroll 150 and the scroll support portion 135 of the main frame 130.

Further, the compression chamber oil supply hole 156 to be described later may be formed in the orbiting end plate 151. One end of the compression chamber oil supply hole 156 may communicate with the oil accommodating portion 155, and another end may communicate with an intermediate pressure chamber of the compression chamber.

Accordingly, oil stored in the oil accommodating portion 155 may be supplied to the compression chamber V through the compression chamber oil supply hole 156 to lubricate the compression chamber. The compression chamber oil supply hole 156 will be described later together with the oil accommodating portion 155.

The orbiting wrap 152 may extend from a lower surface of the orbiting end plate 151 toward the fixed scroll 140. The orbiting wrap 152 may be engaged with the fixed wrap 144 to define the compression chamber V.

The orbiting wrap 152 may be formed in an involute shape together with the fixed wrap 144. However, the orbiting wrap 152 and the fixed wrap 144 may be formed in various shapes other than the involute shape.

Figure 9:
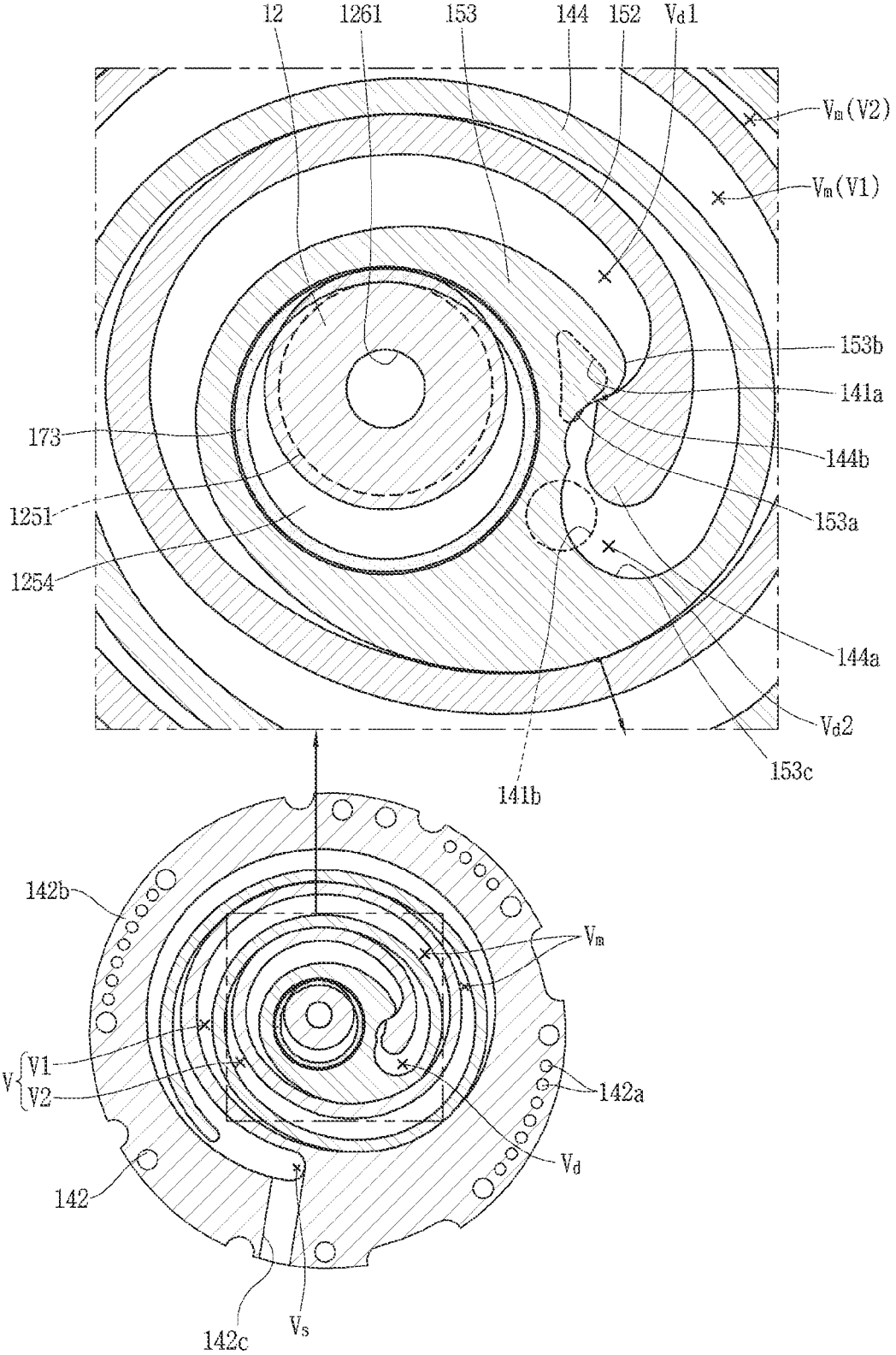
FIG. 9 is a cross-sectional view illustrating a compression chamber of the compression unit according to FIG. 2.

For example, as illustrated in FIG. 9, the orbiting wrap 152 may have a shape formed by connecting a plurality of arcs having different diameters and origins and its outermost curve may be formed substantially in an elliptical shape having a major axis and a minor axis. The fixed wrap 144 may also be formed in a similar manner.

An inner end portion of the orbiting wrap 152 may be formed at a central portion of the orbiting end plate 151, and the rotating shaft coupling portion 153 may be formed through the central portion of the orbiting end plate 151 in the axial direction.

The eccentric portion 1254 of the rotating shaft 125 may be rotatably inserted into the rotating shaft coupling portion 153. An outer circumferential part of the rotating shaft coupling portion 153 may be connected to the orbiting wrap 152 to form the compression chamber V together with the fixed wrap 144 during a compression process.

The rotating shaft coupling portion 153 may be formed at a height at which it overlaps the orbiting wrap 152 on the same plane. That is, the rotating shaft coupling portion 153 may be disposed at a height at which the eccentric portion 1254 of the rotating shaft 125 overlaps the orbiting wrap 152 on the same plane. Accordingly, repulsive force and compressive force of refrigerant may cancel each other while being applied to the same plane based on the orbiting end plate 151, and inclination of the orbiting scroll 150 due to the action between the compressive force and the repulsive force may be suppressed.

In addition, the rotating shaft coupling portion 153 may be provided with a concave portion 153*a* that is formed on an outer circumferential surface thereof, namely, an outer circumferential surface facing an inner end portion of the fixed wrap 144, so as to be engaged with a protruding portion 144*a* of the fixed wrap 144 to be described later. A convex portion 153*b* may be formed at one side of the concave portion 153*a*. The convex portion 153*b* may be formed at an upstream side along a direction in which the compression chamber V is formed, and have a thickness increasing from an inner circumferential surface to an outer circumferential surface of the rotating shaft coupling portion 153.

This may extend a compression path of the first compression chamber V1 immediately before discharge, and consequently a compression ratio of the first compression chamber V1 may be increased to be similar to a pressure ratio of the second compression chamber V2. The first compression chamber V1 is a compression chamber formed between an inner surface of the fixed wrap 144 and an outer surface of the orbiting wrap 152, and will be described later separately from the second compression chamber V2.

At another side of the concave portion 153*a* may be provided an arcuate compression surface 153*c* having an arcuate shape. The diameter of the arcuate compression surface 153*c* may be determined by the thickness of the inner end portion of the fixed wrap 144 (i.e., a thickness of a discharge end) and the orbiting radius of the orbiting wrap 152.

For example, when the thickness of the inner end portion of the fixed wrap 144 increases, the diameter of the arcuate compression surface 153*c* may increase. Accordingly, the thickness of the orbiting wrap around the arcuate compression surface 153*c* may increase so as to ensure durability, and a compression path may extend so as to increase the compression ratio of the second compression chamber V2.

The protruding portion 144*a* protruding toward the outer circumferential surface of the rotating shaft coupling portion 153 may be formed near an inner end portion (suction end or start end) of the fixed wrap 144 corresponding to the rotating shaft coupling portion 153. Accordingly, a contact portion 144*b* may protrude from the protruding portion 144*a* to be engaged with the concave portion 153*a*.

In other words, the inner end portion of the fixed wrap 144 may be formed to have a larger thickness than other portions. Accordingly, wrap strength at the inner end portion of the fixed wrap 144, which is subjected to the strongest compressive force on the fixed wrap 144, may increase so as to enhance durability.

On the other hand, the compression chamber V may be formed in a space defined by the fixed end plate 141, the fixed wrap 144, the orbiting end plate 151 and the orbiting wrap 152. The compression chamber V may include a first compression chamber V1 formed between an inner surface of the fixed wrap 144 and an outer surface of the orbiting wrap 152, and a second compression chamber V2 formed between an outer surface of the fixed wrap 144 and an inner surface of the orbiting wrap 152.

In each of the first compression chamber V1 and the second compression chamber V2, a suction chamber Vs, an intermediate pressure chamber Vm, and a discharge chamber Vd may be continuously formed from outside to inside along an advancing direction of the wrap.

Here, the intermediate pressure chamber Vm and the discharge chamber Vd may be independently formed for each of the first compression chamber V1 and the second compression chamber V2. Accordingly, the first discharge port 141*a* may communicate with the discharge chamber Vd1 of the first compression chamber V1 and the second discharge port 141*b* may communicate with the discharge chamber Vd2 of the second compression chamber V2.

On the other hand, the suction chamber Vs may be formed to be shared by the first compression chamber V1 and the second compression chamber V2. That is, the suction chamber Vs may be formed at an outer side than the orbiting wrap 152 based on the advancing direction of the wrap. Specifically, the suction chamber Vs may be defined as an area that the end of the orbiting wrap 152 does not reach, namely, a space outside an orbiting range of the orbiting wrap 152, in a space between the inner circumferential surface of the fixed side wall 142 and an outer surface of the outermost fixed wrap 144 extending from the fixed side wall 142.

The suction chamber Vs may communicate with the suction through hole 142*c*. Accordingly, the refrigerant suction pipe 115 inserted into the suction through hole 142*c* may communicate with the suction chamber Vs.

Referring back to FIG. 8, on the other hand, an eccentric portion bearing 173 configured as a bush bearing may be inserted into the inner circumferential surface of the rotating shaft coupling portion 153. The eccentric portion 1254 of the rotating shaft 125 may be rotatably inserted into the eccentric portion bearing 173. Accordingly, the eccentric portion 1254 of the rotating shaft 125 may be supported by the eccentric bearing 173 in the radial direction so as to perform a smooth orbiting motion with respect to the orbiting scroll 150.

Here, the oil accommodating portion 155 may be formed inside the rotating shaft coupling portion 153. The oil accommodating portion 155 may communicate with the compression chamber oil supply hole 156 that is formed through the orbiting end plate 151 in the radial direction.

The oil accommodating portion 155 may be formed on an upper side of the eccentric portion bearing 173. For example, an axial length of the eccentric portion bearing 173 may be shorter than an axial length (height) of the rotating shaft coupling portion 153.

Accordingly, a space defined by a difference in length between the eccentric portion bearing 173 and the rotating shaft coupling portion 153 and a thickness of the eccentric portion bearing 173 may be formed on an upper end of the eccentric portion bearing 173. This space may communicate with the third oil hole 1262*c* or the first oil hole 1262*a* of the rotating shaft 125 to define the aforementioned oil accommodating portion 155.

Although not illustrated in an implementation, only one compression chamber oil supply hole 156 may be provided to communicate with any one of the first compression chamber V1 and the second compression chamber V2.

However, in the illustrated implementation, the compression chamber oil supply hole 156 may include a first compression chamber oil supply hole 1561 communicating with the first compression chamber V1, and a second compression chamber oil supply hole 1562 communicating with the second compression chamber V2.

For example, one end of the first compression chamber oil supply hole 1561 and one end of the second compression chamber oil supply hole 1562 may communicate with the oil accommodating portion 155, respectively, and another end of the first compression chamber oil supply hole 1561 and another end of the second compression chamber oil supply hole 1562 may communicate with the second compression chamber V2, respectively.

The first compression chamber oil supply hole 1561 and the second compression chamber oil supply hole 1562 may have the same basic configuration, except for the positions of the ends communicating with the first compression chamber V1 and the second compression chamber V2, respectively. Therefore, hereinafter, the first compression chamber oil supply hole 1561 will be mainly described, and the second compression chamber oil supply hole 1562 will be understood by the description of the first compression chamber oil supply hole 1561.

The first compression chamber oil supply hole 1561 may include an oil supply inlet portion 1561*a*, an oil supply connection portion 1561*b*, an oil supply penetration portion 1561*c*, and an oil supply outlet portion 1561*d*. The oil supply inlet portion 1561*a* may have an inlet end communicating with the oil accommodating portion 155 to configure an inlet of the first compression chamber oil supply hole 1561. The oil supply outlet portion 1561*d* may have an outlet end communicating with the first compression chamber V1 to configure an outlet of the first compression chamber oil supply hole 1561.

Accordingly, oil inside the oil accommodating portion 155 may be supplied to the first compression chamber V1 sequentially through the oil supply inlet portion 1561*a*, the oil supply connection portion 1561*b*, the oil supply penetration portion 1561*c*, and the oil supply outlet portion 1257*d*.

Specifically, the oil supply inlet portion 1561*a* may extend radially from the upper surface of the orbiting end plate 151, and the oil supply connection portion 1561*b* may be formed in a penetrating manner in the axial direction from an end of the oil supply inlet portion 1561*a* to the oil supply penetration portion 1561*c*. The oil supply penetration portion 1561*c* may radially penetrate through the inside of the orbiting end plate, and the oil supply outlet portion 1561*d* may penetrate through the lower surface of the orbiting end plate 151 at an end of the oil supply penetration portion 1561*c* in the radial direction.

Accordingly, the first compression chamber oil supply hole 1561 may allow the communication between the oil accommodating portion 155 and the first compression chamber V1.

In addition, the oil supply inlet portion 1561*a* may extend toward a side to which the back pressure sealing groove 151*a* is eccentric from the rotating shaft coupling portion 153 at an inner side than the back pressure sealing grove 151*a*. However, considering the fact that a first pressure reducing member 1565*a* is installed inside the oil supply penetration portion 1561*c*, the length of the oil supply inlet portion 1561*a* may preferably be formed as short as possible.

In addition, the oil supply inlet portion 1561*a* may communicate with the oil accommodating portion 155 and be recessed into the upper surface of the orbiting end plate 151 by a preset depth. Accordingly, oil contained in the oil accommodating portion 155 may move to the oil supply inlet portion 1561*a* and spread from the inside of the back pressure sealing member 1515 to the upper surface of the orbiting scroll 150, thereby smoothly lubricating a gap between the main frame 130 and the orbiting scroll 150.

In addition, the first pressure reducing member 1565*a* may be inserted into the oil supply penetration portion 1561*c*. The first pressure reducing member 1565*a* may be configured as a pressure reducing pin having an outer diameter smaller than an inner diameter of the oil supply penetration portion 1561*c*. Accordingly, oil in the oil accommodating portion 155 may be decompressed while passing through the first pressure reducing member 1565*a* of the oil supply penetration portion 1561*c* and supplied to the first compression chamber V1.

In addition, the oil supply outlet portion 1561*d* may be formed at a position spaced apart from an outer surface of the outermost orbiting wrap 152 by a preset interval. For example, the oil supply outlet portion 1561*d* may be formed at a position where the first compression chamber oil supply hole 1561 communicates with the first compression chamber V1 and the second compression chamber oil supply hole 1562 communicates with the second compression chamber V2, independently, regardless of an orbiting position (crank angle) of the orbiting scroll 150.

Specifically, the oil supply outlet portion 1561*d* may be formed at a position spaced apart from an outer surface of the outermost orbiting wrap 152 by a value that is obtained by subtracting the inner diameter of the oil supply outlet portion 1561*d* from a wrap thickness on a line of the first compression chamber oil supply hole 1561 in the radial direction. In this case, the oil supply outlet portion 1561*d* of the second compression chamber oil supply hole 1562 provided at the inner side of the outermost orbiting wrap 152 may also be formed at the same position.

Accordingly, even when the plurality of compression chamber oil supply holes 156 is formed, the first compression chamber oil supply hole 1561 may almost communicate only with the first compression chamber V1, and the second compression chamber oil supply hole 1562 may almost communicate only with the second compression chamber V2.

This may present the first compression chamber V1 and the second compression chamber V2 from communicating with each other through the first compression chamber oil supply hole 1561, the second compression chamber oil supply hole 1562, and the oil accommodating portion 155, at an entire orbiting position of the orbiting scroll 150.

This may also prevent backflow of oil from a relatively high-pressure compression chamber to a relatively low-pressure compression chamber due to a pressure difference between the both compression chambers V1 and V2 in a specific orbiting section through the both oil supply holes 1561 and 1562. Accordingly, a constant amount of oil may almost always be supplied to the both compression chambers, which may result in improving reliability of the compressor 10 and reducing friction loss, thereby enhancing compressor performance.

In an implementation not illustrated, when only one compression chamber oil supply hole 156 is provided, the oil supply outlet portion configuring the outlet of the compression chamber oil supply hole 156 may be formed at a position where it alternately communicates with the first compression chamber and the second compression chamber depending on its position during the orbiting motion of the orbiting scroll 150.

Hereinafter, the discharge cover 160 will be described.

Referring back to FIGS. 4 to 6, the discharge cover 160 may include a cover housing portion 161 and a cover flange portion 162. The cover housing portion 161 may have a cover space 161*a* defining the discharge space S4 together with the fixed scroll 140.

The cover housing portion 161 may include a housing bottom surface 1611 and a housing side wall surface 1612 extending in the axial direction from the housing bottom surface 1611 to have an annular shape.

Accordingly, the housing bottom surface 1611 and the housing side wall surface 1612 may define the cover space 161*a* in which outlets of the discharge ports 141*a* and 141*b* and an inlet of the first discharge hole 142*a* all provided in the fixed scroll 140 are accommodated.

The cover space 161*a* may define the discharge space S4 together with a surface of the fixed scroll 140 inserted into the cover space 161*a*.

A cover bearing protrusion 1613 may protrude from a central portion of the housing bottom surface 1611 toward the fixed scroll 140 in the axial direction, and a through hole 1613*a* may formed through the inside of the cover bearing protrusion 1613 in the axial direction.

The sub bearing portion 143 that protrudes from the rear surface of the fixed scroll 140, namely, the fixed end plate 141 in a downward direction (axial direction) may be inserted into the through hole 1613*a*. A cover sealing member 1614 for sealing a gap between an inner circumferential surface of the through hole 1613*a* and an outer circumferential surface of the sub bearing portion 143 may be inserted into the gap.

The housing side wall surface 1612 may extend outward from an outer circumferential surface of the cover housing portion 161 so as to be coupled in close contact with the lower surface of the fixed scroll 140. In addition, at least one discharge guide groove 1612*a* may be formed on an inner circumferential surface of the housing side wall surface 1612 along the circumferential direction. The discharge guide groove 1612*a* may refer to a portion of the housing side wall surface 1612 that is recessed outward in the radial direction.

The first discharge hole 142*a* of the fixed scroll 140 constituting the first refrigerant discharge passage may vertically overlap a space recessed outward in the radial direction due to the formation of the discharge guide groove 1612*a*.

An inner surface of the housing side wall surface 1612 excluding the discharge guide groove 1612*a* may be brought into close contact with the outer circumferential surface of the fixed scroll 140, namely, the outer circumferential surface of the fixed end plate 141 so as to form a type of sealing portion.

The housing side wall surface 1612 may be provided with side wall oil recovery grooves 1612*b* formed on an outer circumferential surface thereof with preset intervals along the circumferential direction so as to define a third oil recovery groove. For example, the side wall oil recovery grooves 1612*b* may be formed on the outer circumferential surface of the housing side wall surface 1612. The side wall oil recovery grooves 1612*b* may define the third oil recovery groove together with a flange oil recovery groove 162*b* of the cover flange portion 162 to be described later.

The third oil recovery groove of the discharge cover 160 may define the second oil recovery passage together with the first oil recovery groove of the main frame 130 and the second oil recovery groove of the fixed scroll 140.

The cover flange portion 162 may extend in the radial direction from an outer circumferential surface of the housing side wall surface 1612 except for a portion where the discharge guide groove 1612*a* is formed. Specifically, the cover flange portion 162 may extend from the outer circumferential surface of an upper side of the housing side wall surface 1612.

The cover flange portion 162 may be provided with coupling holes 162*a* for coupling the discharge cover 160 to the fixed scroll 140 with bolts, and a plurality of flange oil recovery grooves 162*b* formed between the neighboring coupling holes 162*a* at preset intervals in the circumferential direction.

The flange oil recovery grooves 162*b* formed on the cover flange portion 162 may define the third oil recovery groove together with the oil recovery groove 1612*b* formed on the housing side wall surface 1612. The flange oil recovery grooves 162*b* formed on the cover flange portion 162 may be recessed into an outer circumferential surface of the cover flange portion 162 (toward a center) in the radial direction. In the drawings, unexplained reference numeral 21 denotes a condenser fan, and 41 denotes an evaporator fan.

(4) Description of Operation of Scroll Compressor 10

The scroll compressor 10 according to the implementation may operate as follows.

That is, when power is applied to the motor unit 120, rotational force may be generated and the rotor 122 and the rotating shaft 50 may rotate accordingly. As the rotating shaft 50 rotates, the orbiting scroll 180 eccentrically coupled to the rotating shaft 50 may perform an orbiting motion by the Oldham ring 180.

Then, the volume of the compression chamber V may gradually decrease from a suction chamber Vs formed at an outer side of the compression chamber V toward an intermediate pressure chamber Vm continuously formed toward a center and a discharge chamber Vd in a central portion.

Then, refrigerant may move to the accumulator 50 sequentially via the condenser 20, expansion apparatus 30, and evaporator 40 of the refrigeration cycle. The refrigerant may then move toward the suction chamber Vs forming the compression chamber V through the refrigerant suction pipe 115.

The refrigerant sucked into the suction chamber Vs may be compressed while moving to the discharge chamber Vd via the intermediate pressure chamber Vm along a movement trajectory of the compression chamber V. The compressed refrigerant may be discharged from the discharge chamber Vd to the discharge space S4 of the discharge cover 160 through the discharge ports 141*a* and 141*b*.

Then, the refrigerant discharged into the discharge space S4 of the discharge cover 160 may then flow to the lower space S1 between the main frame 130 and the driving motor 120 through the discharge guide groove 1612*a* of the discharge cover 160 and the first discharge holes 142*a* of the fixed scroll 140.

The refrigerant moved to the lower space S1 may flow into the upper space S2 of the casing 110, which is defined above the driving motor 120, through a gap between the stator 121 and the rotor 122.

The refrigerant moved to the upper space S2 may contain oil. However, the oil contained in the refrigerant may be separated from the refrigerant in the upper space S2. The refrigerant from which the oil has been separated may be discharged out of the casing 110 through the refrigerant discharge pipe 116 to flow into the condenser 20 of the refrigeration cycle.

On the other hand, the oil separated from the refrigerant in the upper space S2 may be introduced into the lower space S1 through the first oil recovery passage between the inner circumferential surface of the casing 110 and the stator 121.

The oil introduced into the lower space S1 may be recovered to the oil storage space S3 defined below the compression unit through the second oil recovery passage between the inner circumferential surface of the casing 110 and the outer circumferential surface of the compression unit. This oil may thusly be supplied to each bearing surface (not shown) through the oil supply passage 126, and partially supplied to the compression chamber V. The oil supplied to the bearing surface and the compression chamber V may be discharged to the discharge cover 160 together with the refrigerant and then recovered. This series of processes may be repeatedly performed.

(5) Description of Initial Operation of Scroll Compressor 10

The scroll compressor 10 may operate in the aforementioned operating manner of the scroll compressor 10, and accordingly, liquid refrigerant may move into the oil storage space S3.

Specifically, the refrigerant compressed in the compression chamber may be discharged to the discharge space S4 of the casing 110 through the discharge ports 141*a* and 141*b*. The refrigerant discharged to the discharge space S4 may partially flow to the condenser through the refrigerant discharge pipe 116 while partially mixed with oil to form an oil mixture. Such oil mixture may flow to the lower space S1 through the discharge guide groove 1612*a* and the first discharge holes 142*a*.

The oil mixture moved to the lower space S1 may flow to the upper space S1 through the driving motor 120 so as to be introduced into the oil storage space S3 through the first and second oil recovery passages. At this time, since the refrigerant discharged into the inner space 110*a* of the casing 110 does not reach an appropriate temperature, the oil mixture remaining in the inner space 110*a* of the casing 110 may contain a large quantity of liquid refrigerant which has failed to be vaporized. On the other hand, the oil stored in the inner space 110*a* of the casing 110 may be mixed with the refrigerant discharged from the compression chamber V to form a refrigerant mixture. The refrigerant mixture may then be discharged to outside of the compressor 10 through the refrigerant discharge pipe 116. As a result, in the compressor 10, that is, in the inner space 110*a* of the casing 110, the amount of oil contained in the oil mixture may decrease and the amount of liquid refrigerant may increase, as compared with the state before operation. This may cause the concentration of oil to be gradually lowered.

In this state, when the compressor is kept operating, the concentration of oil may further be lowered, which may be likely to cause friction loss or wear on the bearing surfaces and the compression unit. In addition, since the specific gravity of the liquid refrigerant is higher than that of the oil, two-layer separation may occur that the liquid refrigerant settles down to a lower side of the oil storage space S3 and the oil is pushed up to an upper side of the oil storage space S3. Then, the oil concentration in the lower side of the oil storage space S3 may be lowered, and the concentration of oil pumped up through the lower end of the oil supply pipe 1271 may also be lowered, resulting in fatal damage to the bearing surfaces of the scroll compressor 10.

Furthermore, when the compressor continues to operate normally and the internal temperature of the compressor increases, the large quantity of liquid refrigerant in the oil mixture stored in the oil storage space S3 may be rapidly vaporized, and the oil level of the oil storage space S3 may further be lowered.

When the oil level of the fluid mixture becomes lower than the lower opening of the oil supply pipe 1271, there may be a problem that oil is not supplied at all momentarily. In this case, the rotating shaft 125, the orbiting scroll 150, and the fixed scroll 140 may operate in an insufficiently-lubricated state, and thereby fatal damage to the scroll compressor 10 may occur.

Considering those problems, the scroll compressor 10 according to the implementation may include an oil circulation pipe 117 configured to supply the liquid refrigerant stored in the lower space of the oil storage space S3 to the refrigerant suction pipe 115 during an initial operation.

(6) Description of Oil Level Control Structure of Oil Storage Space S3

The scroll compressor 10 according to the implementation may include an oil level control structure of the oil storage space S3. The oil level control structure may adjust the concentration of oil during a time between an initial operation of scrolls and a timing of securing oil superheat. In addition, the timing of securing the oil superheat may be shortened by the oil level control structure. In other words, at the initial operation, the temperature of the oil mixture accommodated in the oil storage space may rise rapidly, so as to shorten the timing of securing the oil overheat in relation to a proper lubrication state.

Figure 10:
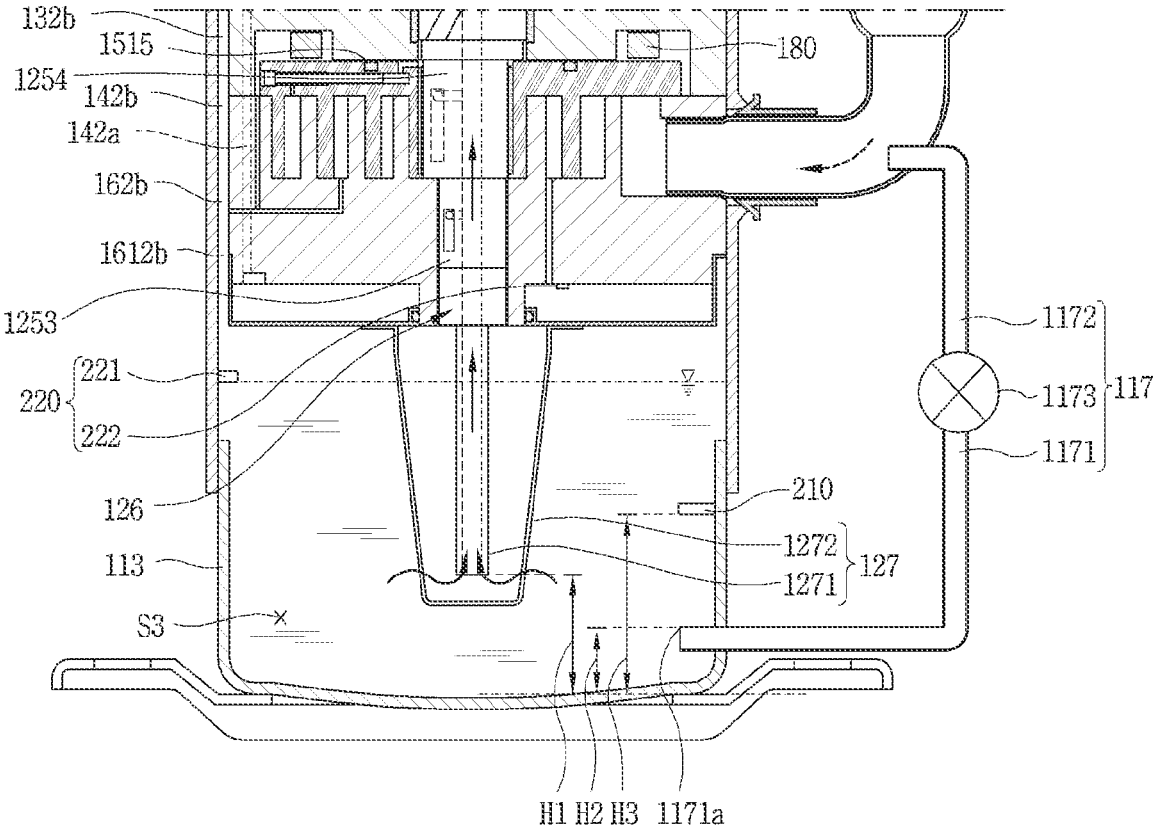
FIG. 10 is an enlarged cross-sectional view of an oil storage space according to FIG. 2.
Figure 11:
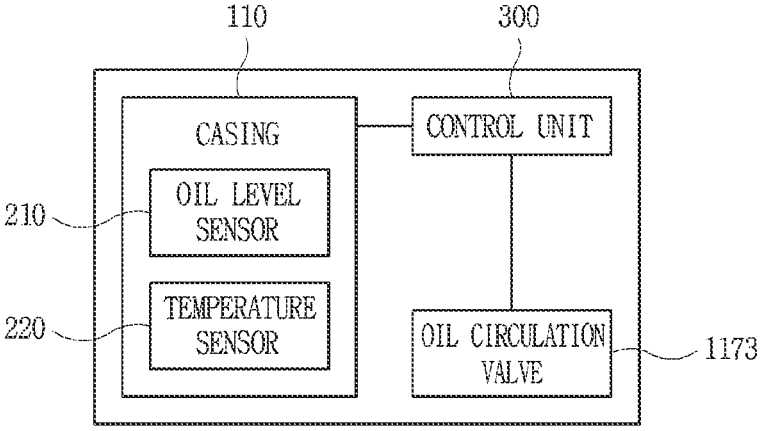
FIG. 11 is a block diagram illustrating a configuration for adjusting an oil level of the oil storage space according to FIG. 2.

Referring to FIGS. 10 and 11, the scroll compressor 10 according to this implementation may include an oil circulation pipe 117, an oil level sensor 210, a temperature sensor 220, and a control unit 300.

The oil circulation pipe 117 may be controlled by the control unit 300 to communicate or block the lower space of the oil storage space S3 and the refrigerant suction pipe 115 with or from each other.

The oil level sensor 210 and the temperature sensor 220 may be provided in the oil storage space S3, and transmit each sensed information to the control unit 300.

The control unit 300 may calculate information regarding whether or not to open or close the oil circulation pipe 117 by using each received information.

First, the oil circulation pipe 117 will be described.

Both ends of the oil circulation pipe 117 may be open. One open end may communicate with the lower portion of the oil storage space S3, and another open end may communicate with the refrigerant suction pipe 115.

The oil circulation pipe 117 may include a first oil circulation pipe 1171 that is a part communicating with the oil storage space S3, and a second oil circulation pipe 1172 that is a part communicating with the refrigerant suction pipe 115. In addition, the oil circulation pipe 117 may further include an oil circulation valve 1173, which may be installed between the first and second oil circulation pipes 1171 and 1172 to communicate or block the first and second oil circulation pipes 1171 and 1172 with or from each other.

One side of the first oil circulation pipe 1171 may be coupled through the lower shell 113 in the radial direction. Accordingly, an open end portion of the one side of the first oil circulation pipe 1171 may communicate with the oil storage space S3.

The first oil circulation pipe 1171 coupled through the lower shell 113 may extend to the outside of the casing 110. Another side of the first oil circulation pipe 1171 located outside the casing 110 may be connected to the second oil circulation pipe 1172 with the oil circulation valve 1173 interposed therebetween.

That is, the another side of the first oil circulation pipe 1171 and one side of the second oil circulation pipe 1172 may be connected to each other by the oil circulation valve 1173. In addition, as the oil circulation valve 1173 is controlled to be opened or closed by the control unit 300, the another side of the first oil circulation pipe 1171 and the one side of the second oil circulation pipe 1172 may communicate with or be blocked from each other.

In one implementation, the oil circulation valve 1173 may be configured as a solenoid valve.

In an implementation not illustrated, the another side of the first oil circulation pipe 1171 and the one side of the second oil circulation pipe 1172 may be integrally formed with each other, and the oil circulation valve 1173 may be disposed in an inner space of the integrally formed first and second oil circulation pipes 1171 and 1172.

Another side of the second oil circulation pipe 1172, opposite to the one side coupled to the oil circulation valve 1173 may be coupled to the refrigerant suction pipe 115 in a penetrating manner. That is, the another side of the second oil circulation pipe 1172 may be inserted into the refrigerant suction pipe 115 from the outside of the casing 110, and an open portion of the another side of the second oil circulation pipe 1172 may communicate with the inner space of the refrigerant suction pipe 115.

Liquid refrigerant and oil (oil mixture) stored in the oil storage space S3 may move to the refrigerant suction pipe 115 via the first oil circulation pipe 1171, the oil circulation valve 1173 and the second oil circulation pipe 1173.

As the scroll compressor 10 operates and the refrigerant compressed by the compression unit is discharged to the inner space 110*a* of the casing 110, pressure in the inner space 110*a* of the casing 110 may increase. Accordingly, pressure in the oil storage space S3 may also gradually increase.

On the other hand, since the inner space of the refrigerant suction pipe 115 connected to the second oil circulation pipe 1172 is a space in which refrigerant before passing through the compression unit stays, relatively low pressure may be generated.

Therefore, when the oil circulation valve 1173 is opened to communicate the first and second oil circulation pipes 1171 and 1172 with each other, the liquid refrigerant in the oil storage space S3 may move toward the refrigerant suction pipe 115 due to a pressure difference between the oil storage space S3 and the refrigerant suction pipe 115.

If a position of an opening 1171*a* of the first oil circulation pipe 1171 facing the oil storage space S3 is excessively high from the bottom of the oil storage space S3, a significant amount oil may contain in the liquid refrigerant moving to the refrigerant suction pipe 115 upon an occurrence of two-layer separation between the liquid refrigerant and the oil.

Accordingly, an uppermost portion of the opening 1171*a* of the first oil circulation pipe 1171 may preferably be located lower than a lower end of the oil supply pipe 1271.

In the illustrated implementation, the uppermost portion of the opening 1171*a* of the first oil circulation pipe 1171 may be disposed farther away from the discharge cover 160 than the lower end of the oil supply pipe 1271.

In the illustrated implementation, a distance H1 between the bottom of the oil storage space S3 and the lower end of the oil supply pipe 1271 may be farther than a distance H2 between the bottom of the oil storage space S3 and the uppermost portion of the opening 1171*a* of the first oil circulation pipe 1171.

In an implementation not illustrated, the uppermost portion of the opening 1171*a* may be disposed on the same line with the lower end of the oil supply pipe 1271 in a horizontal direction.

When two-layer separation occurs, the liquid refrigerant may be intensively gathered on the lower portion of the oil storage space S3. The liquid refrigerant on the lower portion of the oil storage space S3 may then move to the refrigerant suction pipe 115 via the first oil circulation pipe 1171, the oil circulation valve 1173, and the second oil circulation pipe 1172.

Accordingly, the oil level of the fluid mixture of the oil and liquid refrigerant accommodated in the oil storage space S3 may be lowered, and the concentration of the oil may increase. This may result in supplying high concentration of oil through the oil supply pipe 1271, thereby preventing damage to the scroll compressor 10.

In addition, since the liquid refrigerant having a relatively low temperature moves from the oil storage space S3 to the compression chamber V through the refrigerant suction pipe 115, a speed at which the temperature of the oil storage space S3 increases during the initial operation may increase. This may result in moving forward the timing of securing oil superheat.

However, when the oil circulation valve 1173 is always open, the oil level of the oil storage space S3 may be lowered below the lower end of the oil supply pipe 1271. In this case, oil may not be supplied through the oil supply pipe 1271, and thereby fatal damage to the scroll compressor 10 may occur.

Therefore, a method of controlling the oil level of the oil storage space S3 based on the oil level and temperature of the oil storage space S3 is required.

Hereinafter, the oil level sensor 210 that measures the oil level of the oil storage space S3 will be described.

The oil level sensor 210 may be configured to prevent the oil level of the oil storage space S3 from being excessively lowered in advance. When the oil level of the oil storage space S3 is excessively lowered, damage to the scroll compressor 10 may occur. Therefore, the oil level sensor 210 may sense that the oil level of the oil storage space S3 is lowered down to a predetermined height or less.

Since the oil supply is restricted when the oil level of the oil storage space S3 is lower than the position of the lower end of the oil supply pipe 1271, the oil level sensor 210 may preferably be located above the lower end of the oil supply pipe 1271. In one implementation, the oil level sensor 210 may be disposed to be spaced apart 15 mm or more upwards from the lower end of the oil supply pipe 1271.

In the illustrated implementation, a distance H3 between the bottom of the oil storage space S3 and the oil level sensor 210 may be farther than the distance H1 between the bottom of the oil storage space S3 and the oil supply pipe 1271.

This may allow the oil level sensor 210 to sense that the oil level of the oil storage space S3 is excessively lowered. When the oil level of the storage space S3 is excessively lowered, the oil circulation valve 1173 may be controlled to close between the oil storage space S3 and the refrigerant suction pipe 115, thereby suppressing the oil level of the oil storage space S3 from being further lowered. This may result in preventing the stop of the oil supply due to the lowered oil level in advance.

In other words, an appropriate concentration oil may be supplied by discharging the oil mixture through the oil circulation pipe 117 and simultaneously the stop of the oil supply due to the excessively lowered oil level in the oil storage space S3 can be prevented by use of the oil level sensor 210.

Figure 12:
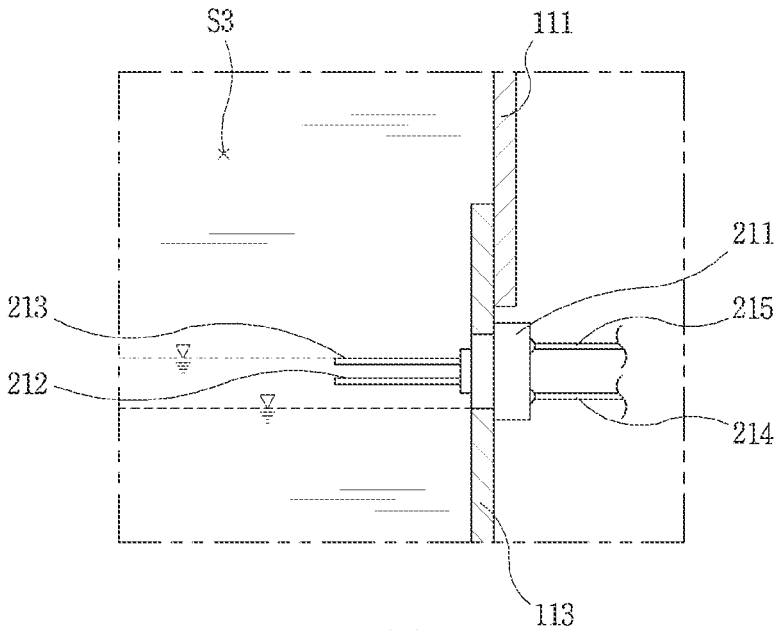
FIG. 12 is a cross-sectional view and a perspective view illustrating one implementation of an oil level sensor according to FIG. 10.
Figure 12:
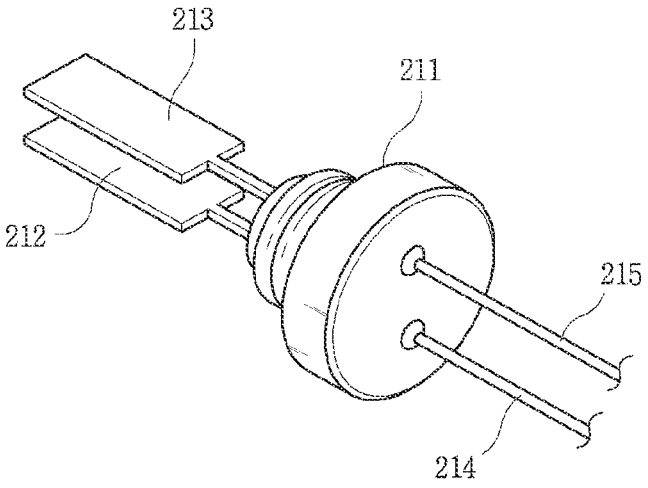

Referring to FIG. 12, an implementation of the oil level sensor 210 is illustrated.

The oil level sensor 210 according to the implementation illustrated in FIG. 12 may include a body part 211 coupled through the lower shell 113, first and second contacts 212 and 213 protruding from the body part 211 to the oil storage space S3, and first and second wires 214 and 215 extending from the body part 211 to the outside of the lower shell 113.

The first and second contacts 212 and 213 may be electrically connected to the first and second wires 214 and 215, respectively, and the first and second wires 214 and 215 may be electrically connected to the control unit 300 to be described later.

The first and second contacts 212 and 213 may be disposed to be spaced apart from each other in the vertical direction. The oil level sensor 210 may detect (determine) a case where the first and second contacts 212 and 213 are all immersed in the fluid mixture of liquid refrigerant and oil and another case where they are not immersed in the fluid mixture.

For example, when both the first and second contacts 212 and 213 are immersed, the control unit 300 may determine that a sufficient oil level is secured and maintain the oil circulation valve 1173 in an open state.

When the oil level is lowered such that both the first and second contacts 212 and 213 immersed in the fluid mixture are not immersed, the control unit 300 may determine that the oil level has excessively been lowered and control the oil circulation valve 1173 to be closed.

That is, in the state where both the first and second contacts 212 and 213 are not immersed, the control unit 300 may close the oil circulation valve 1173.

When the oil level rises again such that both the first and second contacts 212 and 213 not immersed in the fluid mixture are immersed, the control unit may determine that the oil level has sufficiently increased and control the oil circulation valve 1173 to be opened.

In one implementation, the second contact 213 may be disposed above the lower end of the oil supply pipe 1271 (see FIG. 10).

In one implementation, the second contact 213 may be disposed to be spaced apart 15 mm or more upwards from the lower end of the oil supply pipe 1271 (see FIG. 10).

Hereinafter, the temperature sensor 220 will be described.

Referring back to FIGS. 10 and 11, the scroll compressor 10 according to the implementation may include the temperature sensor 220. In FIG. 11, some components of the scroll compressor 10 required to adjust the oil level of the oil storage space S3 and the connection relationship between the components are illustrated.

In the initial operation process of the scroll compressor 10, a case may occur in which a timing of securing oil superheat comes although the oil level of the oil storage space S3 is higher than the oil level sensor 210. In one implementation, at the time when the oil superheat is secured, the oil storage space S3 may have a temperature ranging from 30° C. to 35° C.

When the time at which the oil superheat is secured, the liquid refrigerant may be evaporated and thus the oil at an appropriate concentration can be supplied to the oil supply pipe 1271.

However, when the oil mixture is discharged through the oil circulation pipe 117 while the liquid refrigerant is evaporated, the oil level of the oil storage space S3 may be rapidly lowered. In this case, the oil may not be sufficiently supplied to the compression unit or bearing surfaces due to the shortage of oil to be pumped, which may cause fatal damage to the scroll compressor 10. Therefore, in this case, the oil circulation valve 1173 may preferably be closed to prevent the oil mixture from being discharged through the oil circulation pipe 117.

A first temperature sensor 221 may be attached in the oil storage space S3 to determine whether or not the time of securing the oil superheat comes. The first temperature sensor 221 may detect an internal temperature of the oil storage space S3, and the control unit 300, which will be described later, may compare the temperature detected by the first temperature sensor 221 with a preset temperature for determining the time of securing the oil superheat. In one implementation, the preset temperature may be a temperature in the range of 30° C. to 35° C.

When the temperature detected by the first temperature sensor 221 is equal to or higher than the preset temperature, the control unit 300 may close the oil circulation valve 1173 to suppress the oil level from being excessively lowered instantaneously. In order to receive information sensed by the first temperature sensor 221, the control unit 300 may be electrically connected to the first temperature sensor 221.

A second temperature sensor 222 may be installed on a portion adjacent to the discharge ports 141*a* and 141*b* in the discharge space S4. A sensor for calculating OCR by measuring temperature and pressure of discharged refrigerant may be provided on the portion adjacent to the discharge ports 141*a* and 141*b* in the discharge space S4. If the second temperature sensor 222 pre-installed in the discharge space S4 is used, a separate temperature sensor may not be needed in the oil storage space S3, thereby saving costs. When the second temperature sensor 222 installed in the discharge space S4 is used, the preset temperature may be a temperature in the range of 40° C. to 45° C.

Since whether or not to open or close the oil circulation valve 1173 is determined using both the oil level sensor 210 and the temperature sensor 220, the probability of occurrence of a problem that the oil supply is restricted due to the lowered oil level can be significantly reduced.

Hereinafter, the control unit 300 will be described.

The control unit 300 may receive information detected by each of the sensors 210 and 220 and calculate opening/closing information for opening or closing the oil circulation valve 1173.

To this end, the control unit 300 may be electrically connected to each of the sensors 210 and 220.

The control unit 300 may calculate the opening/closing information using received sensing information.

The control unit 300 may open or close the oil circulation valve 1173 using the calculated opening/closing information. For this purpose, the control unit 300 may be electrically connected to the oil circulation valve 1173.

The control unit 300 may be provided in any form capable of inputting, outputting, and calculating information. In one implementation, the control unit 300 may be provided in the form of a microprocessor, a central processing unit (CPU), a printed circuit board (PCB), a controller, or the like.

The control unit 300 may be located in a predetermined space inside the casing 110. The control unit 300 may be hermetically accommodated in the space so as not to be affected by external moisture or the like.

(7) Description of Opening and Closing Algorithm of Oil Circulation Valve 1173

Figure 13:
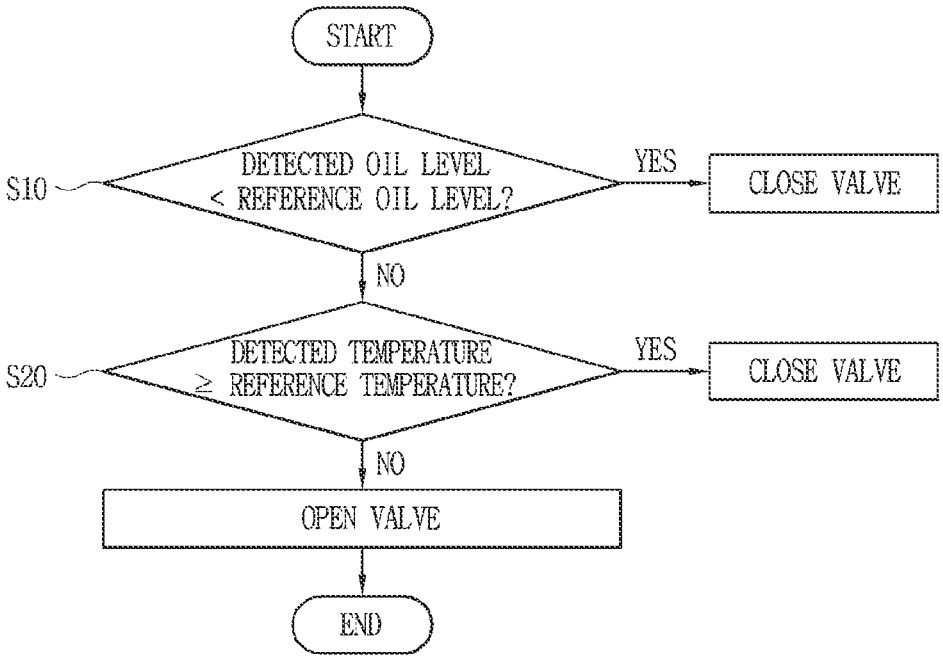
FIG. 13 is a block diagram illustrating an algorithm for adjusting an oil level of an oil storage space according to FIG. 2.

Referring to FIG. 13, an algorithm for controlling the oil circulation valve 1173 by the control unit 300 is illustrated.

First, the control unit 300 may determine whether or not to open or close the oil circulation valve 1173 by receiving the oil level detected by the oil level sensor 210.

When the oil level detected by the oil level sensor 210 is higher than a preset reference oil level, the control unit 300 may open the oil circulation valve 1173 to discharge the liquid refrigerant in the lower portion of the oil storage space S3 to the refrigerant suction pipe 115.

The preset reference oil level may be determined by a height at which the oil level sensor 210 is installed. The preset reference oil level may be set to be higher than a height of the lower end of the oil supply pipe 1271. In addition, the preset reference oil level may be understood as a height of the lowermost portion of the oil level sensor 210 accommodated in the oil storage space S3.

In one implementation, the preset oil level may be a height at a position spaced apart 15 mm or more upwards from the lower end of the oil supply pipe 1271.

In addition, when the oil level detected by the oil level sensor 210 is lower than the preset reference oil level, the control unit 300 may close the oil circulation valve 1173 to prevent the oil level of the oil storage space S3 from being excessively lowered.

Figure 14:
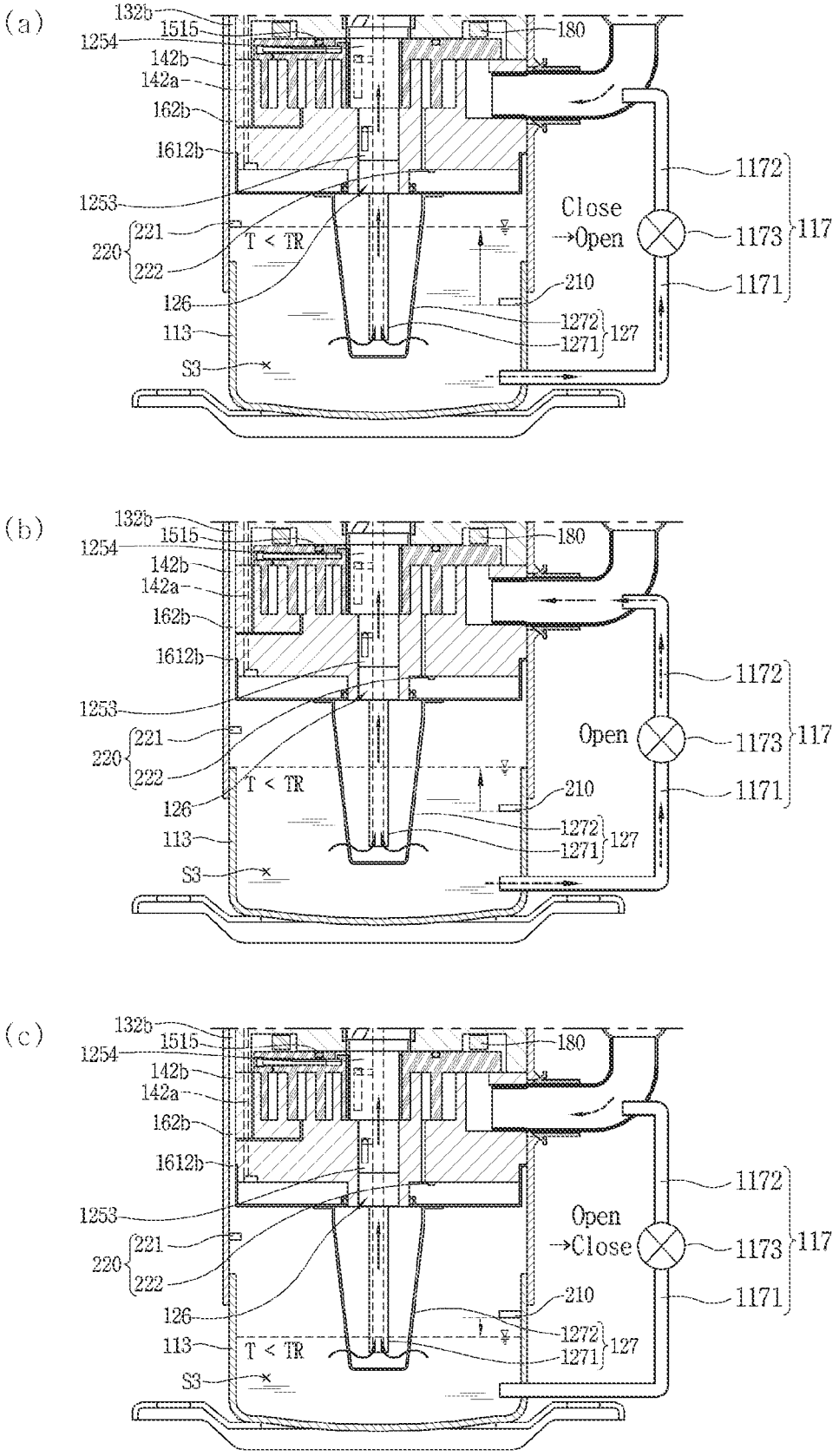
FIG. 14 is a conceptual view illustrating one implementation of a process of adjusting an oil level of an oil storage space by the algorithm according to FIG. 13.

FIG. 14 illustrates a process in which the oil circulation valve 1173 is controlled according to the oil level of the oil storage space S3 in a state in which the temperature of the oil storage space S3 has not reached a preset reference temperature.

First, referring to (a) of FIG. 14, since the oil level detected by the oil level sensor 210 is higher than the preset reference oil level, the control unit 300 may open the oil circulation valve 1173.

Referring to (b) of FIG. 14, as the oil circulation valve 1173 is opened, the liquid refrigerant in the lower portion of the oil storage space S3 may be discharged to the refrigerant suction pipe 115 due to a pressure difference. Accordingly, the oil level of the oil storage space S3 may be lowered and the concentration of the oil may be increased.

Referring to (c) of FIG. 14, as the oil level of the oil storage space S3 becomes lower than the preset reference oil level, the control unit 300 may close the oil circulation valve 1173. As a result, the oil supply may be prevented beforehand from being restricted due to the excessively lowered oil level of the oil storage space S3.

Referring back to FIG. 13, the control unit 300 may receive temperature information detected by the temperature sensor 220, and determine whether to open or close the oil circulation valve 1173.

When the temperature detected by the temperature sensor 220 is lower than a preset reference temperature, the control unit 300 may maintain the open state of the oil circulation valve 1173.

On the other hand, when the temperature detected by the temperature sensor 220 is equal to or higher than the preset reference temperature, the control unit 300 may close the oil circulation valve 1173.

The preset reference temperature may be a temperature of the oil storage space S3 at the timing when the oil superheat is secured. For example, the preset reference temperature may be a temperature in the range of 30° C. to 35° C. In addition, when the temperature sensor 220 is installed in the discharge space S4, the preset reference temperature may be a temperature in the range of 40° C. to 45° C.

Figure 15:
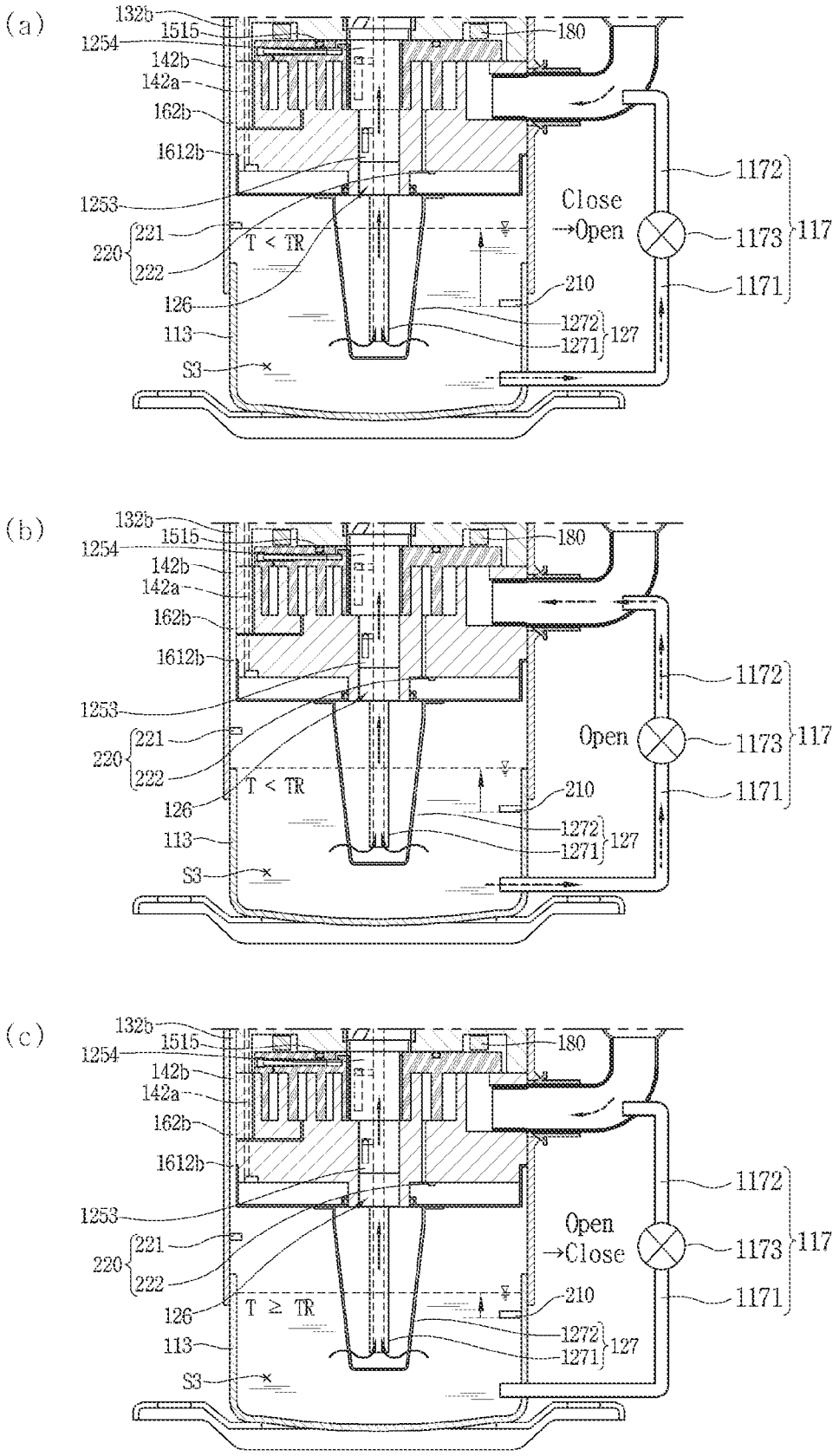
FIG. 15 is a conceptual view illustrating another implementation of a process of adjusting an oil level of an oil storage space by the algorithm according to FIG. 13.

FIG. 15 illustrates a process in which the oil circulation valve 1173 is controlled according to the temperature of the oil storage space S3 in the state in which the oil level of the oil storage space S3 is maintained to be equal to higher than the reference oil level.

First, referring to (a) of FIG. 15, since the oil level detected by the oil level sensor 210 is higher than the preset reference oil level, the control unit 300 may open the oil circulation valve 1173.

Referring to (b) of FIG. 14, as the oil circulation valve 1173 is opened, the liquid refrigerant in the lower portion of the oil storage space S3 may be discharged to the refrigerant suction pipe 115 due to a pressure difference. Accordingly, the oil level of the oil storage space S3 may be lowered and the concentration of the oil may be increased.

Referring to (c) of FIG. 14, in a state where the oil level is higher than the preset reference oil level of the oil storage space S3, the temperature detected by the temperature sensor 220 may rise above a preset reference temperature. Accordingly, the control unit 300 may close the oil circulation valve 1173.

As a result, the oil supply may be prevented beforehand from being restricted due to the excessive lowered oil level of the oil storage space S3.

Since the oil level of the oil storage space S3 is prevented in advance from being excessively lowered by use of both the oil level sensor 210 and the temperature sensor 220, the probability of occurrence of a problem that the oil supply is restricted due to the lowered oil level can be significantly reduced.

(8) Description of Coupling Position of Oil circulation Pipe 117*a*

Figure 16:
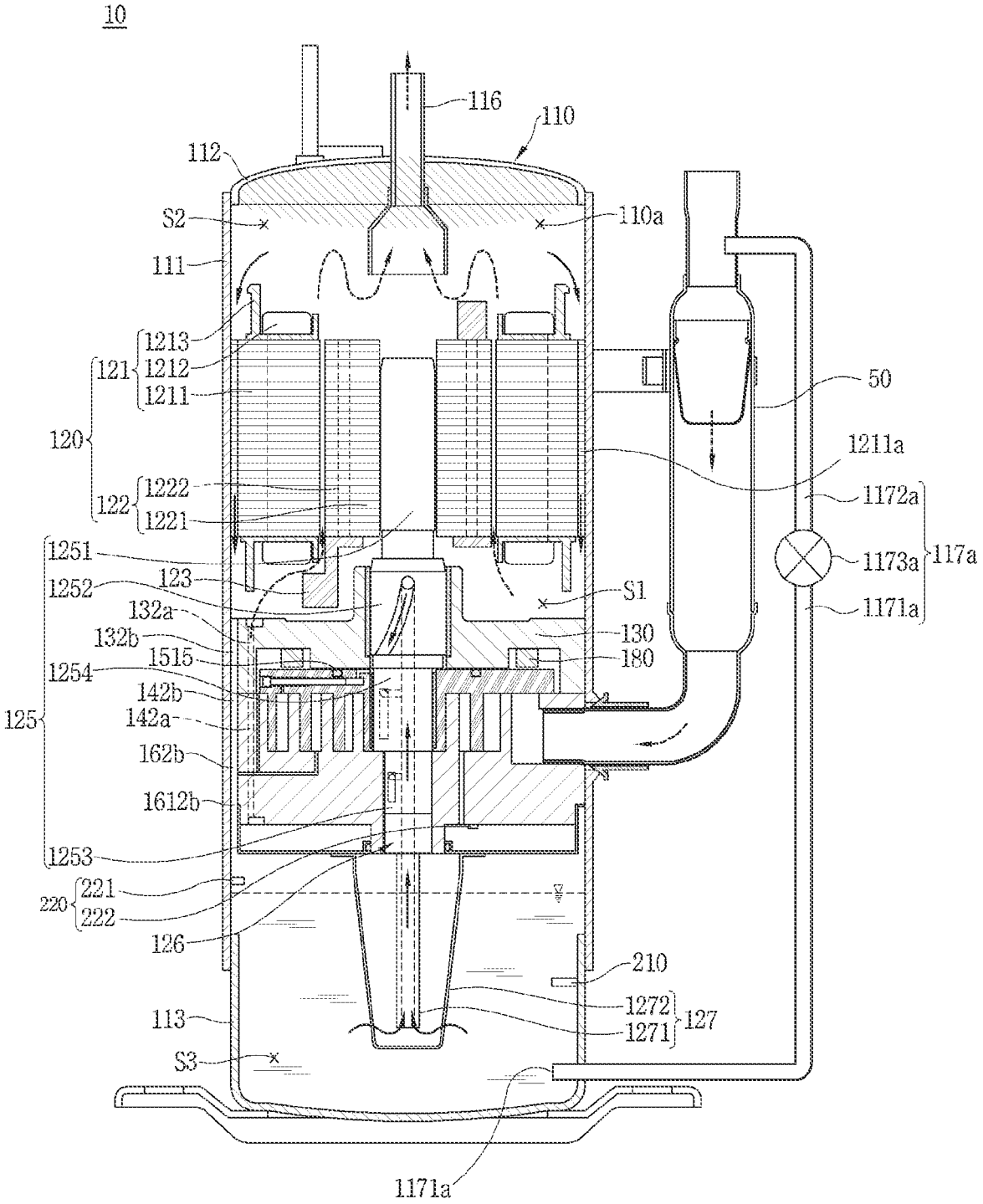
FIG. 16 is a cross-sectional view illustrating an exemplary variation of a scroll compressor according to FIG. 2.
Figure 17:
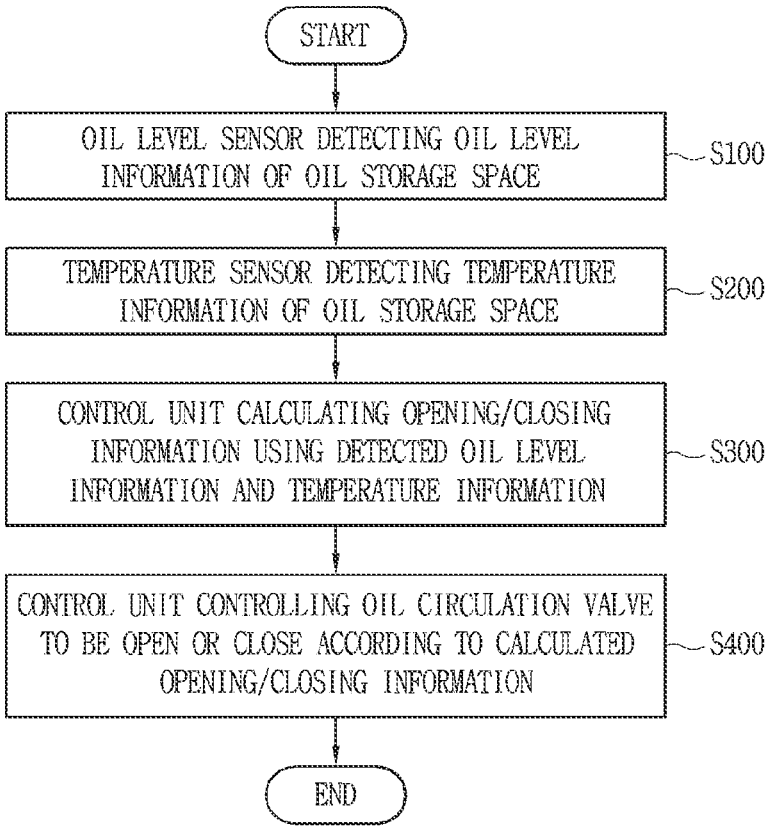
FIG. 17 is a flowchart illustrating a control method of a scroll compressor for adjusting an oil level of an oil storage space according to FIG. 2.
Figure 18:
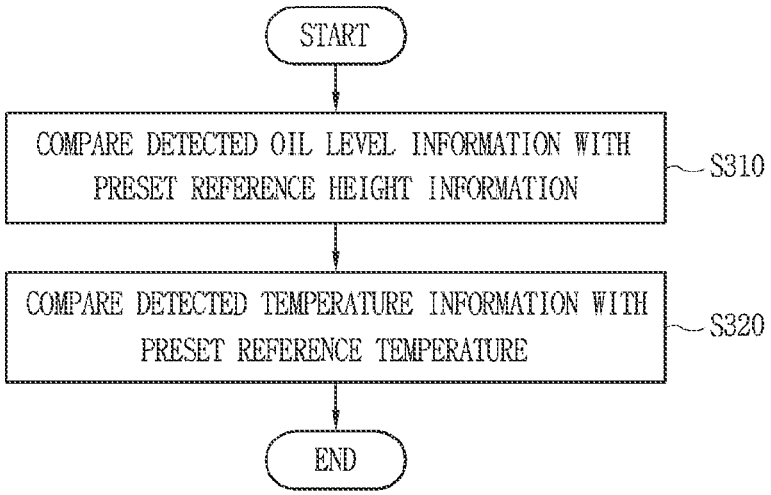
FIG. 18 is a flowchart illustrating a detailed flow of a step S300 of FIG. 17.
Figure 19:
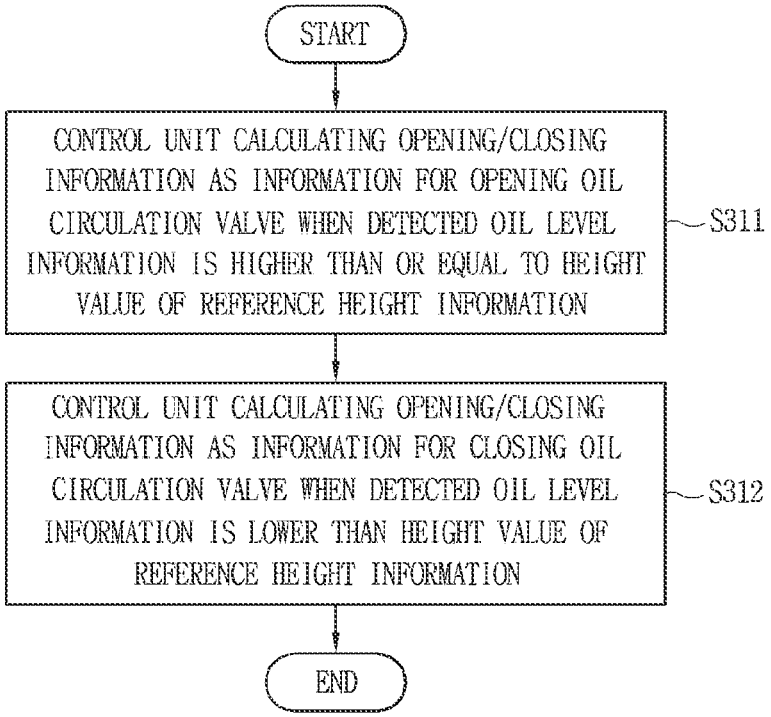
FIG. 19 is a flowchart illustrating a detailed flow of a step S310 of FIG. 18.
Figure 20:
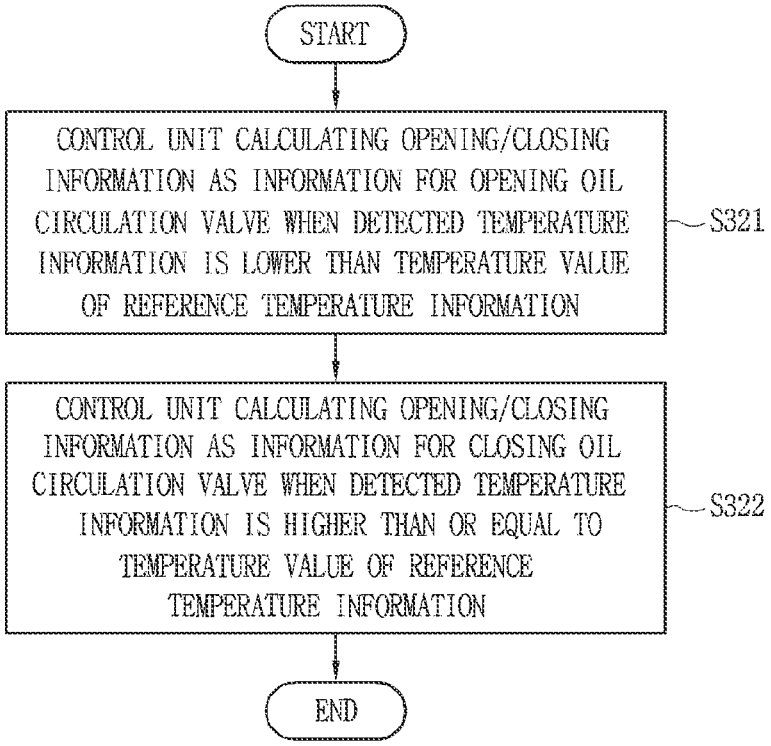
FIG. 20 is a flowchart illustrating a detailed flow of a step S320 of FIG. 18.
Figure 21:
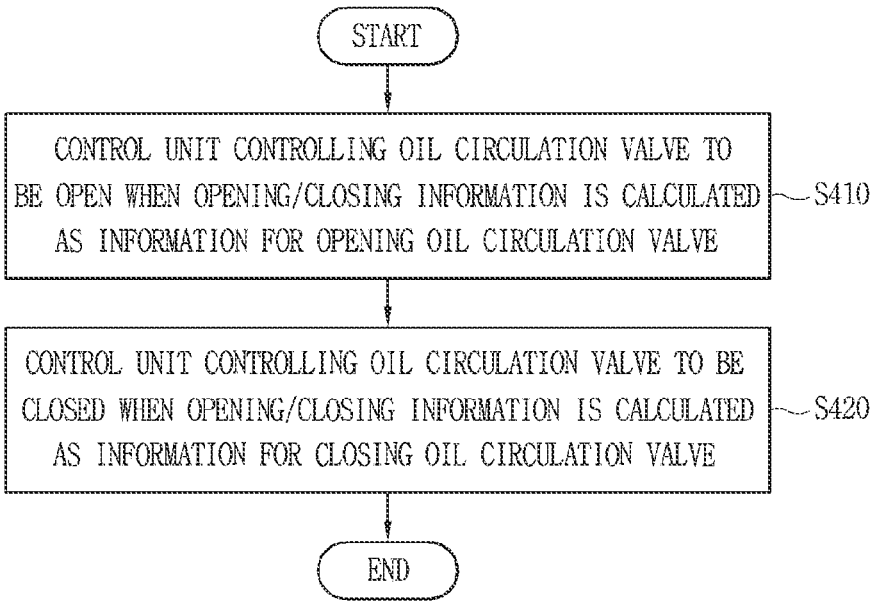
FIG. 21 is a flowchart illustrating a detailed flow of a step S400 of FIG. 17.

Referring to FIG. 16, one end of the oil circulation pipe 117*a* may be coupled through the lower portion of the lower shell 113 in the radial direction. Both ends of the oil circulation pipe 117*a* may be open, and another end of the oil circulation pipe 117*a* may be coupled through an upper portion of the accumulator 50 rather than the refrigerant suction pipe 115. That is, the second oil circulation pipe 1172*a* may be coupled through the upper portion of the accumulator 50 rather than the refrigerant suction pipe 115.

Accordingly, liquid refrigerant stored in the oil storage space S3 may be introduced into the compression chamber V through the accumulator 50.

This may result in accelerating the temperature rise of the oil storage space S3.

4. Description of Control Method of Scroll Compressor 10 According to Implementation Hereinafter, a control method of the scroll compressor 10 for supplying oil of an appropriate concentration by adjusting the oil level of the oil storage space S3 when the scroll compressor 10 initially operates will be described with reference to FIGS. 17 to 21.

(1) Description of Step (S100) of Detecting, by Oil Level Sensor 210, Oil Level Information Regarding Oil Storage Space S3

The oil level sensor 210 may detect oil level information regarding the oil storage space S3. The oil level information may be information including whether the oil level of the oil storage space S3 is equal to or higher than or lower than the oil level sensor 210.

When the oil level of the oil storage space S3 is equal to or higher than the height of the lowermost portion of the oil level sensor 210 accommodated in the oil storage space S3, the oil level information detected may indicate that the oil level of the oil storage space S3 is equal to or higher than the oil level sensor.

On the other hand, when the oil level of the oil storage space S3 is lower than the height of the lowermost portion of the oil level sensor 210 accommodated in the oil storage space S3, the oil level information detected may indicate that the oil level of the oil storage space S3 is lower than the oil level sensor 210.

The detected oil level information may be transmitted to the control unit 300 that is electrically connected to the oil level sensor 210.

(2) Description of Step (S200) of Detecting, by Temperature Sensor 220, Temperature Information Regarding Oil Storage Space S3

The temperature sensor 220 may detect temperature information regarding the oil storage space S3.

The temperature sensor 220 may be attached to an inner wall of the cylindrical shell 111 or the lower shell 113 defining the oil storage space S3 to detect the temperature of the oil storage space S3.

In another implementation, the temperature sensor 220 may be located in the discharge space S4 to detect temperature of refrigerant discharged into the discharge space S4. In this case, a temperature that is 10° C. lower than a temperature of refrigerant detected by the temperature sensor 220 may be substituted as the temperature of the oil storage space S3.

Information related to the temperature detected by the temperature sensor 220 may be transmitted to the control unit 300 that is electrically connected to the temperature sensor 220.

(3) Description of Step (S300) of Calculating, by Control Unit 300, Opening/Closing Information Using Detected Oil Level Information and Temperature Information The control unit 300 may calculate opening/closing information using the detected oil level information and temperature information.

First, the control unit 300 may compare the detected oil level information with preset reference height information (S310).

The preset reference height information may be defined as a height value of the lowermost portion of the oil level sensor 210. The preset reference height information may refer to a height value of a position which is higher than the lower end of the oil supply pipe 1271.

In one implementation, the preset reference height information may be a height value of a position spaced apart 15 mm or more upward from the lower end of the oil supply pipe 1271.

When the transmitted oil level information is information indicating that the oil level of the oil storage space S3 is higher than or equal to the oil level sensor 210, the control unit 300 may determine that the detected oil level information is higher than or equal to the reference height information.

On the other hand, when the transmitted oil level information is information indicating that the oil level of the oil storage space S3 is lower than the oil level sensor 210, the control unit 300 may determine that the detected oil level information is lower than the reference height information.

When the oil level information is higher than or equal to the height value of the reference height information, the control unit 300 may open the oil circulation valve 1173 to lower the oil level of the oil storage space S3.

Accordingly, when the oil level information is higher than or equal to the height value of the reference height information, the control unit 300 may calculate the opening/closing information as information for opening the oil circulation valve 1173 (S311).

When the oil level information is lower than the height value of the reference height information, the control unit 300 may close the oil circulation valve 1173 to prevent the oil level of the oil storage space S3 from being excessively lowered.

Accordingly, when the oil level information is lower than the height value of the reference height information, the control unit 300 may calculate the opening/closing information as information for closing the oil circulation valve 1173 (S312).

In addition, the control unit 300 may compare the detected temperature information with preset reference temperature information (S320).

The preset reference temperature information may refer to the temperature of the storage space S3 at the timing when the oil superheat is secured. For example, the preset reference temperature may be a temperature in the range of 30° C. to 35° C.

When the temperature information is lower than a temperature value of the reference temperature information, the control unit 300 may open the oil circulation valve 1173 to promote a temperature rise in the oil storage space S3.

Accordingly, when the temperature information is lower than the temperature value of the reference temperature information, the control unit 300 may calculate the opening/closing information as information for opening the oil circulation valve 1173 (S321).

When the temperature information is higher than or equal to the temperature value of the reference temperature information, the control unit 300 may close the oil circulation valve 1173 to prevent the oil level of the oil storage space S3 from being excessively lowered instantaneously.

Accordingly, when the temperature information is higher than or equal to the temperature value of the reference temperature information, the control unit 300 may calculate the opening/closing information as information for opening the oil circulation valve 1173 (S322).

(4) Description of Step (S400) of Opening/Closing the Oil Circulation Valve 1173 According to Calculated Opening/Closing Information When the opening/closing information is calculated as information for opening the oil circulation valve 1173, the control unit 300 may control the oil circulation valve 1173 to be opened (S410).

When the opening/closing information is calculated as information for opening the oil circulation valve 1173, the control unit 300 may control the oil circulation valve 1173 to be opened so as to lower the oil level of the oil storage space S3.

When the opening/closing information is calculated as information for closing the oil circulation valve 1173, the control unit 300 may control the oil circulation valve 1173 to be closed (S420).

When the opening/closing information is calculated as information for closing the oil circulation valve 1173, the control unit 300 may control the oil circulation valve 1173 to be closed so as to prevent the oil level of the oil storage space S3 from being excessively lowered.

Those steps S100, S200, S300 and S400 described above may be performed repeatedly throughout the process.

5. Description of Scroll Compressor According to Another Implementation

Hereinafter, a scroll compressor according to another implementation will be described with reference to FIGS. 22 to 28.

The scroll compressor according to the another implementation may be a scroll compressor in which a stirring blade 1273 is further provided in the scroll compressor 10 according to the one implementation described with reference to FIGS. 1 to 21.

Except for the addition of the stirring blade 1273, the scroll compressor according to the another implementation may be the same as the scroll compressor 10 according to the one implementation described with reference to FIGS. 1 to 21.

Figure 22:
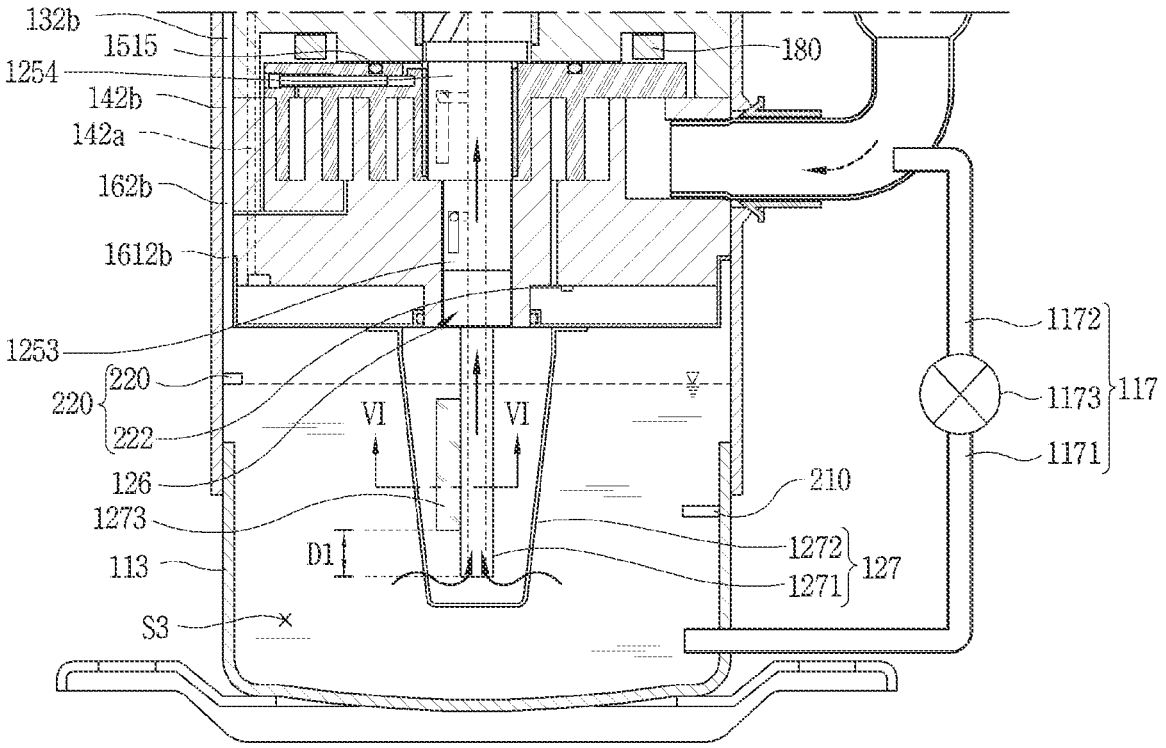
FIG. 22 is an enlarged cross-sectional view illustrating an oil storage space of a scroll compressor in accordance with another implementation of the present disclosure.

Referring to FIG. 22, a stirring blade 1273 may protrude from the outer circumferential surface of the oil supply pipe 1271 to extend away from the discharge cover 160. The stirring blade 1273, that is, may extend in the vertical direction from the outer circumferential surface of the oil supply pipe 1271. In the implementation, the stirring blade 1273 may be configured in the form of a rectangular plate.

The stirring blade 1273 may rotate together with the oil supply pipe 1271 as the rotating shaft 125 rotates.

The rotating stirring blade 1273 may apply external force to oil stored in the oil storage space S3, and accordingly, liquid refrigerant saturated in the stored oil may be vaporized.

Since the concentration of the oil increases as the liquid refrigerant is vaporized, insufficient lubrication of the compression unit due to low concentration of oil can be suppressed.

A lower end of the stirring blade 1273 may be spaced apart from the lower end of the oil supply pipe 1271 by a predetermined distance. In one implementation, the lower end of the stirring blade 1273 may be spaced apart 5 mm or more upward from the lower end of the oil supply pipe 1271.

Figure 23:
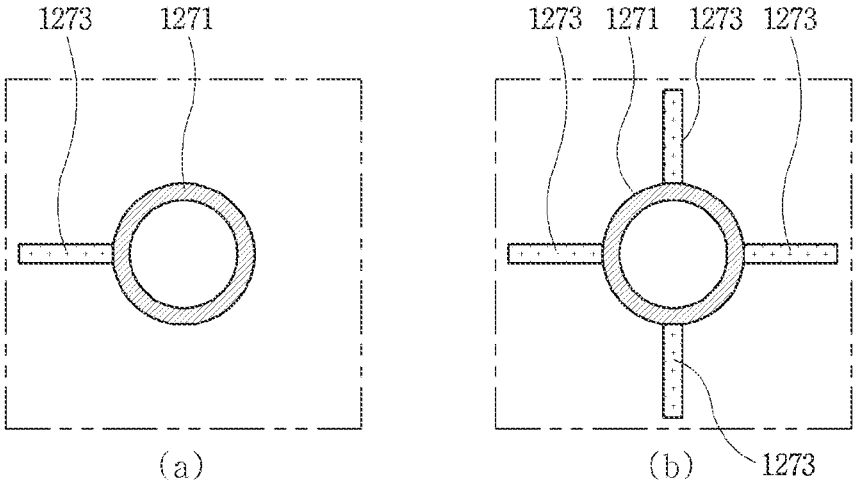
FIG. 23 is a cross-sectional view taken along line VI-VI of FIG. 22.

Referring to FIG. 23, the stirring blade 1273 may protrude from the outer circumferential surface of the oil supply pipe 1271 in the radial direction. In this instance, the stirring blade 1273 may be provided by only one as illustrated in (a) of FIG. 23, or provided in plurality as illustrated in (b) of FIG. 23.

When the stirring blade 1273 is provided in plurality, it may be advantageous in terms of oil supply in that the plurality of stirring blades 1273 is disposed at equal intervals along the outer circumferential surface of the oil supply pipe 1271.

Although not illustrated, a protruded length and number of the stirring blade 1273 may vary depending on the shape of the oil storage space S3.

Figure 24:
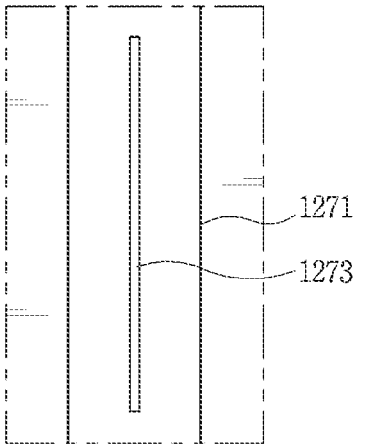
FIG. 24 is a front view illustrating exemplary variations of a stirring wing according to FIG. 22.
Figure 24:
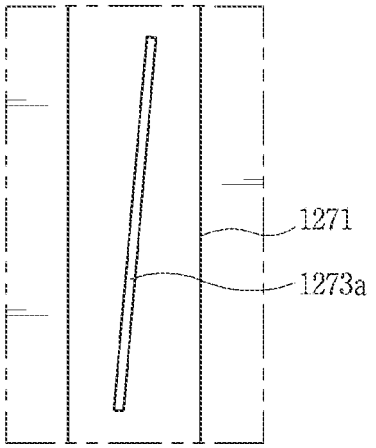
Figure 24:
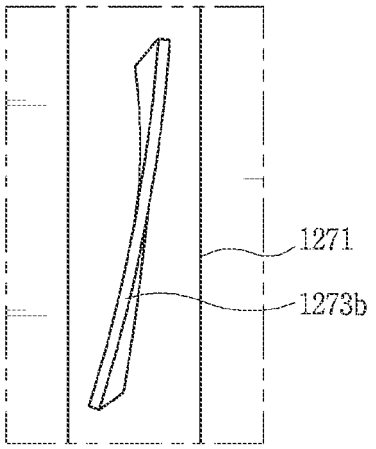

Referring to FIG. 24, modified examples of the stirring blade 1273 are shown.

In (a) of FIG. 24, the stirring blade 1273 illustrated in FIG. 22 is shown. In the illustrated implementation, the stirring blade 1273 may extend up and down along the lengthwise direction of the oil supply pipe 1271.

In addition, referring to (b) of FIG. 24, a stirring blade 1273*a* may extend at a predetermined angle with the lengthwise direction of the oil supply pipe 1271. That is, the stirring blade 1273*a* may be a member in the form of a rectangular plate forming an inclination of a predetermined angle with respect to the vertical (up and down) direction.

In addition, referring to (c) of FIG. 24, a stirring blade 1273*b* may be formed in a spiral shape surrounding the outer circumferential surface of the oil supply pipe 1271 clockwise or counterclockwise along the lengthwise direction.

Figure 25:
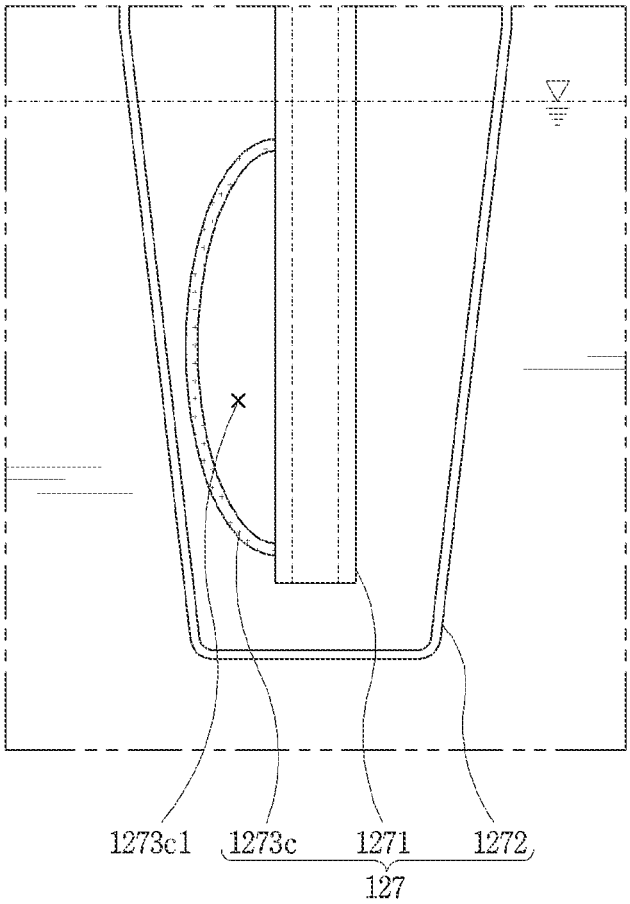
FIG. 25 is a cross-sectional view illustrating an exemplary variation of a stirring wing according to FIG. 22.

Referring to FIG. 25, both ends of a stirring blade 1273*c* may be spaced apart from each other in the lengthwise direction of the oil supply pipe 1271 and respectively coupled to the outer circumferential surface of the oil supply pipe 1271. In addition, a portion of the stirring blade 1273*c* that connects the both ends may be spaced apart from the outer circumferential surface of the oil supply pipe 1271. In the illustrated implementation, the stirring blade 1273*c* may have both upper and lower ends coupled to the outer circumferential surface of the oil supply pipe 1271 and the portion (e.g., extension portion) connecting the both ends may be curved outward in the radial direction of the oil supply pipe 1271.

Since a space defining an oil passage 1273*c*1 between the stirring blade 1273*c* and the outer circumferential surface of the oil supply pipe 1271, an excessive flow of the fluid toward the lower side of the oil supply pipe 1271 may be suppressed by rotation of the stirring blade d1273*c*.

Accordingly, owing to the stirring blade 1273*c*, the saturated liquid refrigerant may be separated and simultaneously the oil may be smoothly introduced into the oil supply pipe 1271.

Figure 26:
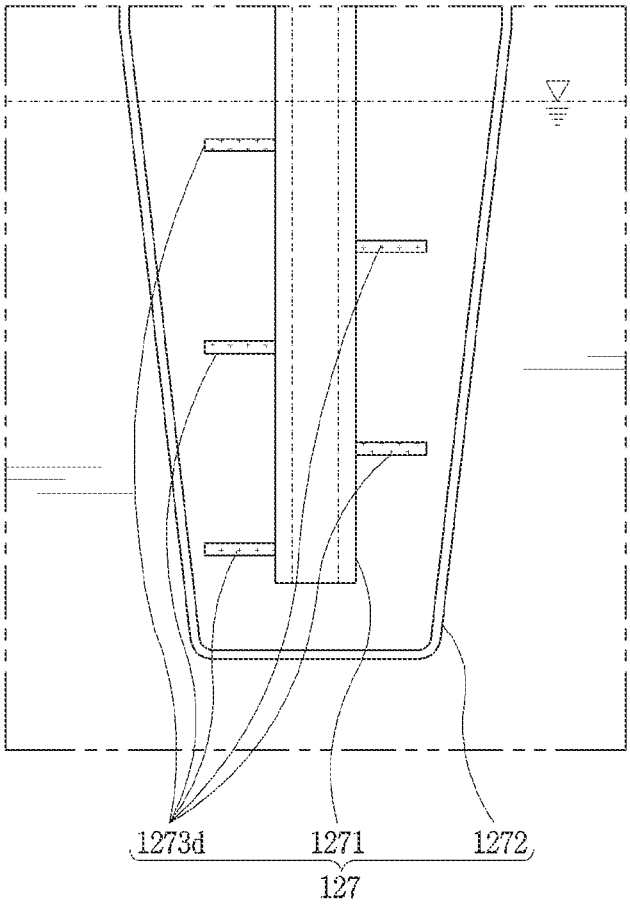
FIG. 26 is a cross-sectional view illustrating an exemplary variation of a stirring wing according to FIG. 22.

Referring to FIG. 26, stirring blades 1273*d* may alternatively extend in a radial direction or a direction corresponding to the radial direction.

Specifically, the stirring blade 1273*d* may be formed in a shape of a rod or in a shape of a circular or semicircular plate that is thin in the axial direction and wide in the radial direction. One end or an inner circumferential surface of the stirring blade 1273*d* may be coupled to the outer circumferential surface of the oil supply pipe 1271 and another end or an outer circumferential surface of the stirring blade 1273*d* may form a free end.

In the case where the stirring blades 1273*d* have the rod or semicircular shape, the left and right stirring blades 1273*d* may be coupled at the same height along the axial direction, but may alternatively be coupled in a zigzag form with height differences along the axial direction as illustrated in FIG. 26. The oil can be effectively stirred when the stirring blades 1273*d* are coupled in the zigzag form.

Accordingly, a contact area between the stirring blades 1273*c* and the liquid refrigerant and the oil may be reduced in the direction in which the stirring blades 1273*d* rotates.

Accordingly, the excessive flow of the fluid to the lower side of the oil supply pipe 1271 can be suppressed by rotation of the stirring blades 1273*d*. Accordingly, owing to the stirring blades 1273*d*, the saturated liquid refrigerant may be separated and simultaneously the oil may be smoothly introduced into the oil supply pipe 1271.

Figure 27:
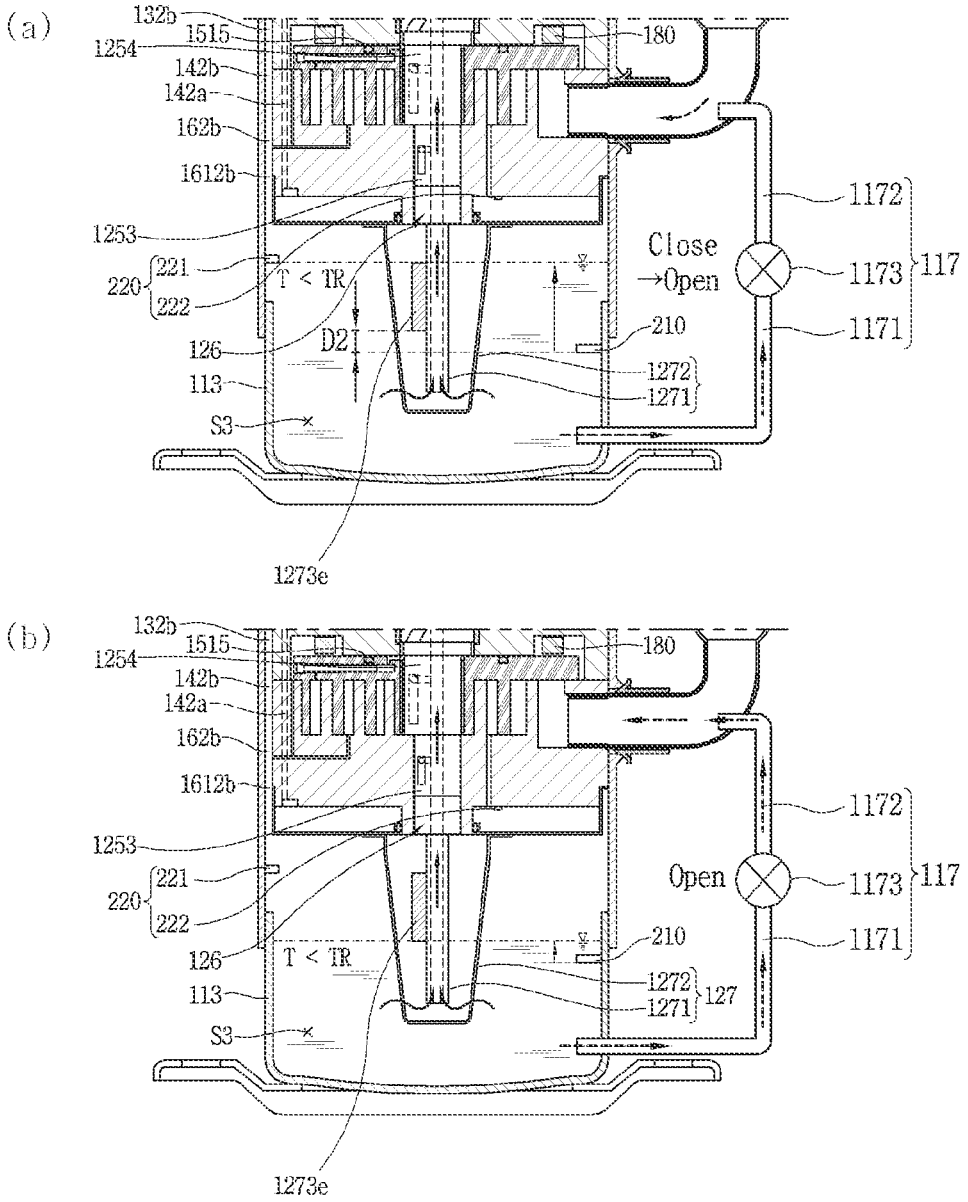
FIG. 27 is a conceptual view illustrating one implementation of a process of adjusting an oil level of an oil storage space of the scroll compressor according to FIG. 22.

Referring to FIG. 27, a lower end of a stirring blade 1273*e* may be disposed closer to the discharge cover 160 than to the oil level sensor 210. That is, the lower end of the stirring blade 1273*e* may be disposed higher than the oil level sensor 210.

In a state where the oil level of the oil storage space S3 is adjacent to the oil level sensor 210, if excessive external force is applied to the oil by the stirring blade 1273*e*, the oil level of the oil storage space S3 may be excessively lowered instantaneously.

However, referring to (b) of FIG. 27, when the oil level of the oil storage space S3 is lowered to be adjacent to the oil level sensor 210 and thus located lower than the lower end of the stirring blade 1273*d*, the oil may not be affected by the stirring blade 1273*e* any more.

As a result, when the oil level of the oil storage space S3 is adjacent to the oil level sensor 210, the oil level of the oil storage space S3 may be prevented in advance from being excessively lowered instantaneously.

Figure 28:
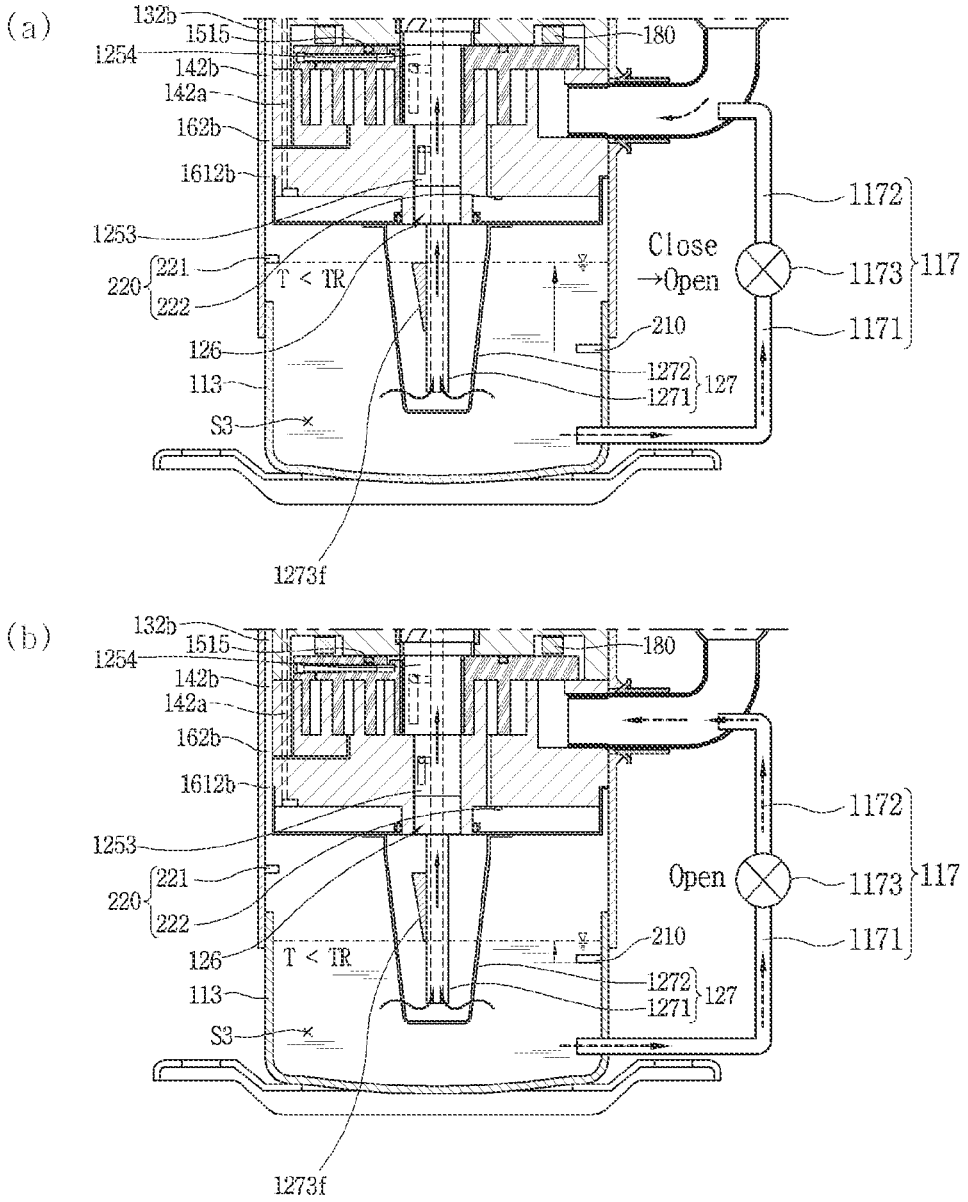
FIG. 28 is a conceptual view illustrating another implementation of a process of adjusting an oil level of an oil storage space of the scroll compressor according to FIG. 22.

Referring to FIG. 28, a stirring blade 1273*f* may be formed such that its width decreases toward the lower end of the oil supply pipe 1271.

In the illustrated implementation, the stirring blade 1273*f* may have a cross-section in the shape of an inverted triangle.

However, the present disclosure is not limited thereto, and in an implementation not shown, a side surface of the stirring blade 1273*f* facing a protruding direction of the stirring blade 1273*f* may be formed in an arcuate shape in which a distance from the outer circumferential surface of the oil supply pipe 1271 decreases downward.

Referring to (b) of FIG. 28, as the oil level of the oil storage space S3 is lowered to be adjacent to the oil level sensor 210, a contact area between the stirring blade 1273*d* and the liquid refrigerant and oil may gradually decrease. Accordingly, as the oil level of the oil storage space S3 is lowered down toward the lower side of the stirring blade 1273*f*, the affection of the stirring blade 1273*f* with respect to the oil may gradually decrease.

The foregoing description has been given of the preferred implementation, but it will be understood by those skilled in the art that various modifications and changes can be made without departing from the scope of the present disclosure described in the appended claims.

What is claimed is:

1. A scroll compressor comprising:

a casing that defines an oil storage space in a lower portion of an inner space of the casing;

a motor disposed in the inner space of the casing;

a fixed scroll disposed within the inner space of the casing, wherein the motor and the fixed scroll are arranged along an axial direction;

an orbiting scroll engaged with the fixed scroll and configured to perform an orbiting motion relative to the fixed scroll, the orbiting scroll being configured to define a compression chamber together with the fixed scroll during the orbiting motion;

a rotating shaft coupled to the motor and to the orbiting scroll;

a refrigerant suction pipe that is connected from an outside of the casing to the compression chamber through the casing, the refrigerant suction pipe defining a suction passage configured to supply refrigerant from the outside of the casing to the compression chamber;

an oil circulation pipe having a first end connected to the oil storage space through the casing and a second end connected to the suction passage;

an oil circulation valve disposed between the first end and the second end of the oil circulation pipe, the oil circulation valve being configured to selectively open and close the oil circulation pipe;

an oil supply pipe that is coupled to a lower end of the rotating shaft and extends to the oil storage space in the axial direction, the oil supply pipe having a lower end that is open to the oil storage space; and a controller configured to control the oil circulation valve to be selectively opened and closed, wherein the first end of the oil circulation pipe is disposed at a position vertically lower than or equal to a position of the lower end of the oil supply pipe.

2. The scroll compressor of claim 1, further comprising an oil level sensor disposed in the casing and configured to detect an oil level of oil stored in the oil storage space, wherein the controller is configured to:

control the oil circulation valve to be open based on the oil level being greater than or equal to a preset value, and control the oil circulation valve to be closed based on the oil level being less than the preset value.

3. The scroll compressor of claim 2, wherein the oil level sensor is installed at a position vertically higher than or equal to a position of the first end of the oil circulation pipe.

4. The scroll compressor of claim 1, further comprising a temperature sensor disposed in the casing and configured to detect an internal temperature of the inner space of the casing, wherein the controller is configured to:

control the oil circulation valve to be opened based on the internal temperature being less than or equal to a preset temperature, and control the oil circulation valve to be closed based on the internal temperature being greater than the preset temperature.

5. The scroll compressor of claim 4, further comprising a discharge cover arranged below the fixed scroll to define a discharge space with the fixed scroll, and wherein the temperature sensor comprises at least one of:

a first temperature sensor installed in the casing between the discharge cover and the oil storage space, the first temperature sensor having the preset temperature in a range of 30° C. to 35° C.; or a second temperature sensor installed in the discharge space, the second temperature sensor having the preset temperature in a range of 40° C. to 45° C.

6. The scroll compressor of claim 1, further comprising:

an oil level sensor disposed in the oil storage space of the casing and configured to detect an oil level of oil stored in the oil storage space; and a temperature sensor disposed in the casing and configured to detect an internal temperature of the inner space of the casing, the temperature sensor being disposed in a space opposite to the oil storage space with respect to the motor.

7. The scroll compressor of claim 6, wherein the oil level sensor and the temperature sensor are electrically connected to the controller, and wherein the controller is configured to control the oil circulation valve based on at least one of the oil level or the internal temperature.

8. The scroll compressor of claim 1, further comprising:

at least one stirring blade disposed at an outer circumferential surface of the oil supply pipe.

9. The scroll compressor of claim 8, wherein the at least one stirring blade extends in the axial direction.

10. The scroll compressor of claim 9, further comprising an oil level sensor disposed in the casing, wherein one end of the at least one stirring blade in the axial direction is located vertically above the oil level sensor.

11. The scroll compressor of claim 9, wherein the at least one stirring blade protrudes radially outward from the outer circumferential surface of the oil supply pipe, and wherein a protruded width of the at least one stirring blade in a radial direction decreases toward an end of the oil supply pipe in the axial direction.

12. The scroll compressor of claim 8, wherein the at least one stirring blade extends in the axial direction and defines a predetermined angle with respect to the axial direction.

13. The scroll compressor of claim 8, wherein the at least one stirring blade has a spiral shape that surrounds the outer circumferential surface of the oil supply pipe in a clockwise or counterclockwise direction and that extends in the axial direction.

14. The scroll compressor of claim 8, wherein the at least one stirring blade has:

a first end that is coupled to a first portion of the outer circumferential surface of the oil supply pipe;

a second end that is spaced apart from the first end in the axial direction and coupled to a second portion of the outer circumferential surface of the oil supply pipe; and an extension portion that extends from the first end to the second end, the extension portion being spaced apart from the outer circumferential surface of the oil supply pipe to thereby define an oil passage inside the at least one stirring blade.

15. The scroll compressor of claim 8, wherein the at least one stirring blade has a first end coupled to the outer circumferential surface of the oil supply pipe and a second end that defines a free end spaced apart from the outer circumferential surface of the oil supply pipe.

16. A method for controlling the scroll compressor according to claim 1, the method comprising:

sensing, by an oil level sensor, an oil level of oil stored in the oil storage space;

sensing, by a temperature sensor, an internal temperature of the inner space of the casing;

determining, by the controller, opening/closing information based on the oil level and the internal temperature; and opening or closing the oil circulation valve based on the opening/closing information.

17. The method of claim 16, wherein determining the opening/closing information comprises:

comparing the oil level to a preset reference height; and comparing the internal temperature to a preset reference temperature.

18. The method of claim 17, wherein determining the opening/closing information comprises:

determining, by the controller, that the opening/closing information corresponds to information for opening the oil circulation valve based on the oil level being greater than or equal to the preset reference height; and determining, by the controller, that the opening/closing information corresponds to information for closing the oil circulation valve based on the oil level being less than the preset reference height.

19. The method of claim 17, wherein determining the opening/closing information comprises:

determining, by the controller, that the opening/closing information corresponds to information for opening the oil circulation valve based on the internal temperature being less than the preset reference temperature; and determining, by the controller, that the opening/closing information corresponds to information for closing the oil circulation valve based on the internal temperature being greater than or equal to the preset reference temperature.

20. The scroll compressor of claim 1, wherein the oil circulation pipe has an opening that is defined at the first end of the oil circulation pipe and in fluid communication with the oil storage space, and wherein an uppermost portion of the opening is located lower than the lower end of the oil supply pipe.

* * * * *